US008401843B2

(12) United States Patent
Eksler et al.

(10) Patent No.: US 8,401,843 B2
(45) Date of Patent: Mar. 19, 2013

(54) METHOD AND DEVICE FOR CODING TRANSITION FRAMES IN SPEECH SIGNALS

(75) Inventors: Vaclav Eksler, Sherbrooke (CA); Milan Jelinek, Sherbrooke (CA); Redwan Salami, St-Laurent (CA)

(73) Assignee: VoiceAge Corporation, Québec (CA)

( * ) Notice: Subject to any disclaimer, the term of this patent is extended or adjusted under 35 U.S.C. 154(b) by 939 days.

(21) Appl. No.: 12/446,892

(22) PCT Filed: Oct. 24, 2007

(86) PCT No.: PCT/CA2007/001896

§ 371 (c)(1),
(2), (4) Date: Jun. 23, 2009

(87) PCT Pub. No.: WO2008/049221

PCT Pub. Date: May 2, 2008

(65) Prior Publication Data

US 2010/0241425 A1 Sep. 23, 2010

Related U.S. Application Data

(60) Provisional application No. 60/853,749, filed on Oct. 24, 2006.

(51) Int. Cl.
*G10L 19/00* (2006.01)
*G10L 19/12* (2006.01)
*G10L 21/02* (2006.01)

(52) U.S. Cl. ..... 704/219; 704/221; 704/226

(58) Field of Classification Search ..... None
See application file for complete search history.

(56) References Cited

U.S. PATENT DOCUMENTS

| | | | | |
|---|---|---|---|---|
| 5,119,424 | A | 6/1992 | Asakawa et al. | |
| 5,495,555 | A | 2/1996 | Swaminathan | |
| 5,528,727 | A * | 6/1996 | Wang | 704/223 |
| 6,192,335 | B1 * | 2/2001 | Ekudden et al. | 704/223 |
| 6,233,550 | B1 | 5/2001 | Gersho et al. | |
| 6,768,978 | B2 * | 7/2004 | Amada et al. | 704/212 |
| 7,092,885 | B1 * | 8/2006 | Yamaura | 704/264 |
| 7,260,522 | B2 | 8/2007 | Gao et al. | |

(Continued)

FOREIGN PATENT DOCUMENTS

| | | |
|---|---|---|
| EP | 0 926 660 | 6/1999 |
| EP | 1 355 298 | 10/2003 |

(Continued)

OTHER PUBLICATIONS

Silva et al., "CELP with priority to critical segments", Eusipco-98: European Signal Processing Conference, pp. 717-720, 1998.*

(Continued)

*Primary Examiner* — Brian Albertalli
(74) *Attorney, Agent, or Firm* — Fay Kaplun & Marcin, LLP

(57) ABSTRACT

There is provided a transition mode device and method for use in a predictive-type sound signal codec for producing a transition mode excitation replacing an adaptive codebook excitation in a transition frame and/or a frame following the transition in the sound signal, comprising an input for receiving a codebook index and a transition mode codebook for generating a set of codevectors independent from past excitation. The transition mode codebook is responsive to the index for generating, in the transition frame and/or frame following the transition, one of the codevectors of the set corresponding to the transition mode excitation. There is also provided an encoding device and method and a decoding device and method using the above described transition mode device and method.

59 Claims, 14 Drawing Sheets

U.S. PATENT DOCUMENTS

| | | | | |
|---|---|---|---|---|
| 7,373,298 | B2 * | 5/2008 | Ehara | 704/233 |
| 7,660,712 | B2 | 2/2010 | Gao et al. | |
| 2001/0053972 | A1 | 12/2001 | Amanda et al. | |
| 2004/0148162 | A1 | 7/2004 | Fingscheidt et al. | |
| 2005/0203737 | A1 | 9/2005 | Miyazaki | |
| 2005/0240399 | A1 | 10/2005 | Makinen | |
| 2008/0071530 | A1 * | 3/2008 | Ehara | 704/223 |
| 2010/0125455 | A1 * | 5/2010 | Wang et al. | 704/219 |

FOREIGN PATENT DOCUMENTS

| | | |
|---|---|---|
| EP | 1 640 970 | 3/2006 |
| RU | 2 257 556 | 7/2005 |
| RU | 2 262 748 | 10/2005 |
| WO | 99/10719 | 3/1999 |
| WO | 01/82293 | 11/2001 |
| WO | 01/91112 | 11/2001 |
| WO | 2006/048733 | 5/2006 |

OTHER PUBLICATIONS

Zhang Xiongwei; Chen Xianzhi; , "A new excitation model for LPC vocoder at 2.4 kb/s," Acoustics, Speech, and Signal Processing, 1992. ICASSP-92., 1992 IEEE International Conference on , vol. 1, no., pp. 65-68 vol. 1, Mar. 23-26, 1992.*

Linden, J.; Skoglund, J.; Hedelin, P.; , "Low Rate Speech Coding using a Glottal Pulse Codebook," Speech Coding for Telecommunications, 1995. Proceedings., 1995 IEEE Workshop on , vol., no., pp. 105-106, Sep. 20-22, 1995.*

Anderson et al., "ILBC—A Linear Predictive Coder with Robustness to Packet Loss", Speech Coding, 2002 IEEE Workshop Proceedings, pp. 23-25, Oct. 2002.

Chibani et al., "Fast Recovery for a CELP-Like Speech Codec After a Frame Erasure", IEEE Transactions on Audio, Speech and Language Processing, vol. 15, No. 8, Nov. 2007, pp. 2485-2495.

Anderson et al., "Pitch Resynchronization while Recovering from a Late Frame in a Predictive Speech Decoder", IEEE Int. Conf. on Acoustics, Speech and Signal Processing, Toulouse, France, May 2006, pp. 245-248.

Mc. Elroy et al., "WideBand Speech Coding Using Multiple Codebooks and Glotttal Pulses", DSP Research Group, Dept. of Electronic and Electricla Engineering, University College, Dublin, Ireland, 1995, pp. 253-256.

Bessette et al., "The Adaptive Multi-Rate Wideband Speech Codec (AMR-WB)", Special Issue of IEEE Transactions on Speech and Audio Processing, vol. 10, No. 8, Nov. 2002, pp. 620-636.

Salami et al., "A Toll Quality 8 KB/S Speech Codec for the Personal Communications System (PCS)", IEEE Trans. on Vehicular Technology, Aug. 1994, vol. 43, No. 3, pp. 808-816.

"Source-Controlled Variable-Rate Multimode Wideband Speech Codec (VMR-WB), Service Options 62 and 63 for Spread Spectrum Systems", 3GPP2 Tech. Spec. C.S0052-A v1.0, Apr. 2005; http://www.3gpp2.org, pp. 1-198.

Lloyd, "Least Squares Quanitzation in PCM", IEEE Transactions on Information Theory, Mar. 1982, vol. 28, No. 2, pp. 129-136.

"3rd Generation Partnership Project; Technical Specification Group Services and System Aspects; Speech Codec Speech Processing Functions; Adaptive Multi-Rate-Wideband (AMR-WB+) Speech Codec, Transcoding Functions", 3GPP Tech. Spec. 26.290, Jun. 2005, 53 pages.

"Extended High-Level Description of the Q9 EV-VBR baseline Codec", VoiceAge Nokia, ITU-T SG16 Tech. Cont. COM16-C199R1-E, Jun. 2007, pp. 1-13.

Chu, "Speech Coding Algorithms, Foundations and Evolution of Standardized Coders", John Wiley & Sons, ISBN: 0-471-373312-5, 2003, pp. 1-578.

* cited by examiner

METHOD AND DEVICE FOR CODING TRANSITION FRAMES IN SPEECH SIGNALS

FIELD OF THE INVENTION

The present invention relates to a technique for digitally encoding a sound signal, for example a speech or audio signal, in view of transmitting and synthesizing this sound signal.

More specifically, but not exclusively, the present invention relates a method and device for encoding transition frames and frames following the transition in a sound signal, for example a speech or audio signal, in order to reduce the error propagation at the decoder in case of frame erasure and/or to enhance coding efficiency mainly at the beginning of voiced segments (onset frames). In particular, the method and device replace the adaptive codebook typically used in predictive encoders by a codebook of, for example, glottal impulse shapes in transition frames and in frames following the transition. The glottal-shape codebook can be a fixed codebook independent of the past excitation whereby, once the frame erasure is over, the encoder and the decoder use the same excitation so that convergence to clean-channel synthesis is quite rapid. In onset frame coding in traditional CELP, the past excitation buffer is updated using the noise-like excitation of the previous unvoiced or inactive frame that is very different from the current excitation. On the other hand, the proposed technique can build the periodic part of the excitation very accurately.

BACKGROUND

A speech encoder converts a speech signal into a digital bit stream which is transmitted over a communication channel or stored in a storage medium. The speech signal is digitized, that is sampled and quantized with usually 16-bits per sample. The speech encoder has the role of representing these digital samples with a smaller number of bits while maintaining a good subjective speech quality. The speech decoder or synthesizer operates on the transmitted or stored bit stream and converts it back to a speech signal.

Code-Excited Linear Prediction (CELP) coding is one of the best prior art techniques for achieving a good compromise between subjective quality and bit rate. This coding technique forms the basis of several speech coding standards both in wireless and wireline applications. In CELP coding, the sampled speech signal is processed in successive blocks of M samples usually called frames, where M is a predetermined number corresponding typically to 10-30 ms. A linear prediction (LP) filter is computed and transmitted every frame. The computation of the LP filter typically needs a lookahead, a 5-15 ms speech segment from the subsequent frame. The M-sample frame is divided into smaller blocks called subframes. Usually the number of subframes is three or four resulting in 4-10 ms subframes. In each subframe, an excitation signal is usually obtained from two components, the past excitation and the innovative, fixed-codebook excitation. The component formed from the past excitation is often referred to as the adaptive codebook or pitch excitation. The parameters characterizing the excitation signal are coded and transmitted to the decoder, where the reconstructed excitation signal is used as the input of the LP filter.

CELP-type speech codecs rely heavily on prediction to achieve their high performance. The prediction used can be of different kinds but usually comprises the use of an adaptive codebook containing an excitation signal selected in past frames. A CELP encoder exploits the quasi periodicity of voiced speech signal by searching in the past excitation the segment most similar to the segment being currently encoded. The same past excitation signal is maintained also in the decoder. It is then sufficient for the encoder to send a delay parameter and a gain for the decoder to reconstruct the same excitation signal as is used in the encoder. The evolution (difference) between the previous speech segment and the currently encoded speech segment is further modeled using an innovation selected from a fixed codebook. The CELP technology will be described in more detail herein below.

A problem of strong prediction inherent in CELP-based speech coders appears in presence of transmission errors (erased frames or packets) when the state of the encoder and the decoder become desynchronized. Due to the prediction, the effect of an erased frame is thus not limited to the erased frame, but continues to propagate after the erasure, often during several following frames. Naturally, the perceptual impact can be very annoying.

Transitions from unvoiced speech segment to voiced speech segment (e.g. transition between a consonant or a period of inactive speech, and a vowel) or transitions between two different voiced segments (e.g. transitions between two vowels) are the most problematic cases for frame erasure concealment. When a transition from unvoiced speech segment to voiced speech segment (voiced onset) is lost, the frame right before the voiced onset frame is unvoiced or inactive and thus no meaningful periodic excitation is found in the buffer of the past excitation (adaptive codebook). At the encoder, the past periodic excitation builds up in the adaptive codebook during the onset frame, and the following voiced frame is encoded using this past periodic excitation. Most frame error concealment techniques use the information from the last correctly received frame to conceal the missing frame. When the onset frame is lost, the decoder past excitation buffer will be thus updated using the noise-like excitation of the previous frame (unvoiced or inactive frame). The periodic part of the excitation is thus completely missing in the adaptive codebook at the decoder after a lost voiced onset and it can take up to several frames for the decoder to recover from this loss.

A similar situation occurs in the case of lost voiced to voiced transition. In that case, the excitation stored in the adaptive codebook before the transition frame has typically very different characteristics from the excitation stored in the adaptive codebook after the transition. Again, as the decoder usually conceals the lost frame with the use of the past frame information, the state of the encoder and the decoder will be very different, and the synthesized signal can suffer from important distortion.

OBJECTS OF THE INVENTION

An object of the present invention is therefore to provide a method and device for encoding transition frames in a predictive speech and/or audio encoder in order to improve the encoder robustness against lost frames and/or improve the coding efficiency.

Another object of the present invention is to eliminate error propagation and increase coding efficiency in CELP-based codecs by replacing the inter-frame dependent adaptive codebook search by a non-predictive, for example glottal-shape, codebook search. This technique requires no extra delay, negligible additional complexity, and no increase in bit rate compared to traditional CELP encoding.

SUMMARY OF THE INVENTION

More specifically, in accordance with one aspect of the present invention, there is provided a transition mode method for use in a predictive-type sound signal codec for producing a transition mode excitation replacing an adaptive codebook excitation in a transition frame and/or a frame following the transition in the sound signal, comprising: providing a transition mode codebook for generating a set of codevectors independent from past excitation; supplying a codebook index to the transition mode codebook; and generating, by means of the transition mode codebook and in response to the codebook index, one of the codevectors of the set corresponding to the transition mode excitation.

According to a second aspect of the present invention, there is provided a transition mode device for use in a predictive-type sound signal codec for producing a transition mode excitation replacing an adaptive codebook excitation in a transition frame and/or a frame following the transition in the sound signal, comprising an input for receiving a codebook index and a transition mode codebook for generating a set of codevectors independent from past excitation. The transition mode codebook is responsive to the index for generating, in the transition frame and/or frame following the transition, one of the codevectors of the set corresponding to said transition mode excitation.

According to a third aspect of the present invention, there is provided an encoding method for generating a transition mode excitation replacing an adaptive codebook excitation in a transition frame and/or a frame following the transition in a sound signal, comprising: generating a codebook search target signal; providing a transition mode codebook for generating a set of codevectors independent from past excitation, the codevectors of the set each corresponding to a respective transition mode excitation; searching the transition mode codebook for finding the codevector of the set corresponding to a transition mode excitation optimally corresponding to the codebook search target signal.

According to a fourth aspect of the present invention, there is provided an encoder device for generating a transition mode excitation replacing an adaptive codebook excitation in a transition frame and/or a frame following the transition in a sound signal, comprising: a generator of a codebook search target signal; a transition mode codebook for generating a set of codevectors independent from past excitation, the codevectors of the set each corresponding to a respective transition mode excitation; and a searcher of the transition mode codebook for finding the codevector of the set corresponding to a transition mode excitation optimally corresponding to the codebook search target signal.

According to a fifth aspect of the present invention, there is provided a decoding method for generating a transition mode excitation replacing an adaptive codebook excitation in a transition frame and/or a frame following the transition in a sound signal, comprising: receiving a codebook index; supplying the codebook index to a transition mode codebook for generating a set of codevectors independent from past excitation; and generating, by means of the transition mode codebook and in response to the codebook index, one of the codevectors of the set corresponding to the transition mode excitation.

According to a sixth aspect of the present invention, there is provided a decoder device for generating a transition mode excitation replacing an adaptive codebook excitation in a transition frame and/or a frame following the transition in a sound signal, comprising an input for receiving a codebook index and a transition mode codebook for generating a set of codevectors independent from past excitation. The transition mode codebook is responsive to the index for generating in the transition frame and/or frame following the transition one of the codevectors of the set corresponding to the transition mode excitation.

The foregoing and other objects, advantages and features of the present invention will become more apparent upon reading of the following non-restrictive description of an illustrative embodiment thereof, given by way of example only with reference to the accompanying drawings.

DETAILED DESCRIPTION

Figure 1:
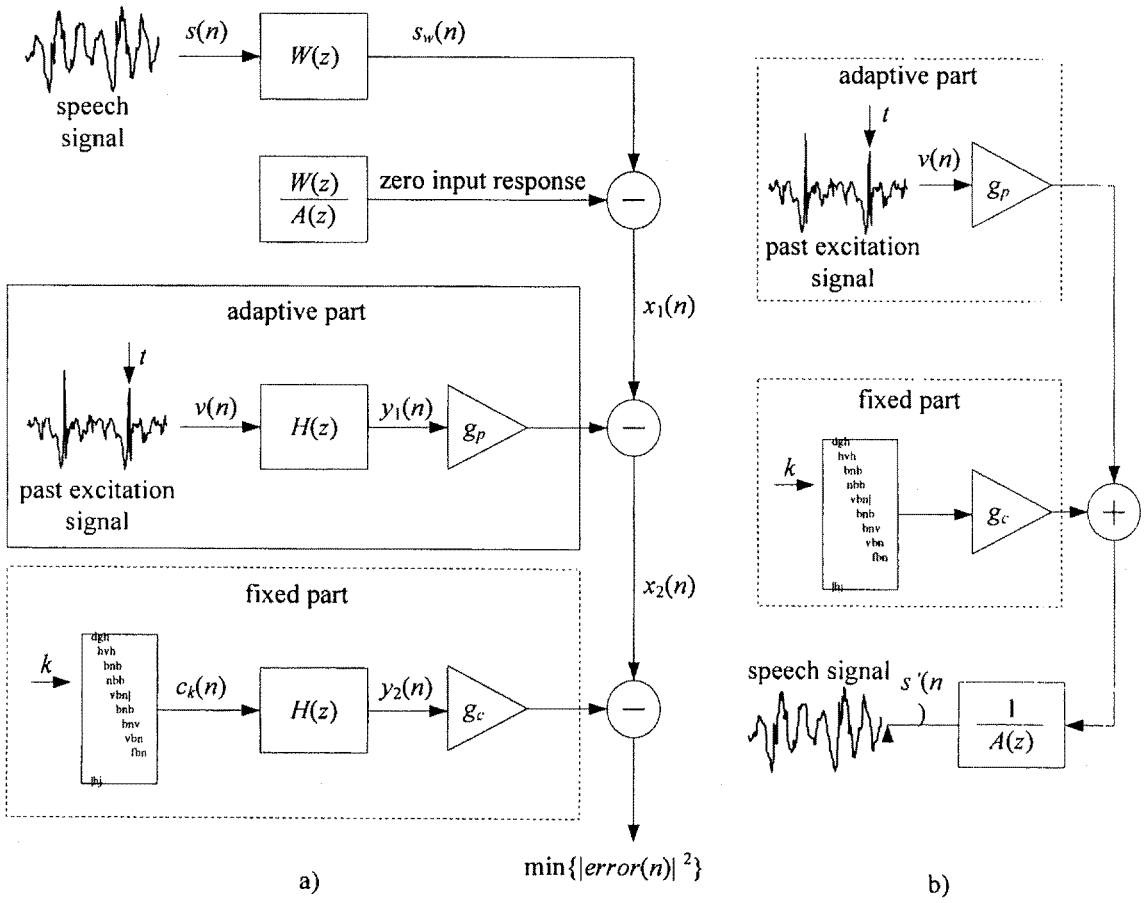
FIG. 1*a* is a schematic block diagram of a CELP-based encoder.
FIG. 1*b* is a schematic block diagram of a CELP-based decoder.

The non-restrictive illustrative embodiment of the present invention is concerned with a method and device whose purpose is to overcome error propagation in the above described situations and increase the coding efficiency.

More specifically, the method and device according to the non-restrictive illustrative embodiment of the present invention implement a special encoding, called transition mode (TM) encoding technique, of transition frames and frames following the transition in a sound signal, for example a speech or audio signal. The TM coding technique replaces the adaptive codebook of the CELP codec by a new codebook of glottal impulse shapes, hereinafter designated as glottal-shape codebook, in transition frames and in frames following the transition. The glottal-shape codebook is a fixed codebook independent of the past excitation. Consequently, once a frame erasure is over, the encoder and the decoder use the same excitation whereby convergence to clean-channel synthesis is quite rapid.

While the use of the TM coding technique in frames following a transition helps to prevent error propagation in the case the transition frame is lost, another purpose of using the TM coding technique also in the transition frame is to improve the coding efficiency. For example, just before a voiced onset, the adaptive codebook usually contains a noise-like signal not very efficient for encoding the beginning of a voiced segment. The idea behind the TM coding technique is thus to supplement the adaptive codebook with a better codebook populated with simplified quantized versions of glottal impulses to encode the voiced onsets.

The proposed TM coding technique can be used in any CELP-type codec or predictive codec. As an example, the TM coding technique is implemented in a candidate codec in ITU-T standardization activity for an Embedded Variable Bit Rate Codec that will be referred to in the remaining of the text as EV-VBR codec. Although the non-restrictive illustrative embodiment of the present invention will be described in connection with the EV-VBR codec framework, it should be kept in mind that the principles and concepts of the present invention are not limited to an application to the EV-VBR codec but to any other codec using predictive coding. Also, although the non-restrictive illustrative embodiment of the present invention will be described in connection with a speech signal, it should be kept in mind that the present invention is not limited to an application to speech signals but its principles and concepts can be applied to any other types of sound signals including audio signals.

A speech frame can be roughly classified into one of the four (4) following speech classes (this will be explained in more detail in the following description):

- Inactive frames characterized by the absence of speech activity;
- Unvoiced speech frames characterized by an aperiodic structure and energy concentration toward higher frequencies;
- Voiced speech frames having a clear quasi-periodic nature with energy concentrated mainly in low frequencies; and
- Any other frame classified as a transition having rapidly varying characteristics.

In the EV-VBR codec, a specialized coding mode has been designed for each of the classes. It can be generally stated that the inactive frames are processed through comfort noise generation, the unvoiced speech frames through an optimized unvoiced encoding mode, the voiced speech frames through an optimized voiced encoding mode and all other frames are processed with a generic Algebraic CELP (ACELP) technology. In the EV-VBR codec framework, the TM coding technique is thus introduced as yet another encoding mode in the EV-VBR encoding scheme to encode transition frames and frames following the transition.

Figure 27:
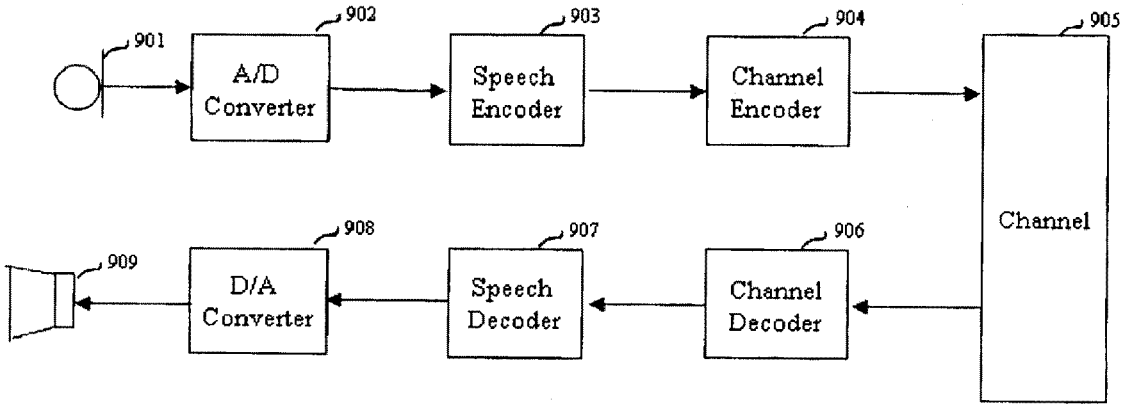
FIG. 27 is a schematic block diagram of a speech communication system illustrating the use of speech encoding and decoding devices.

FIG. 27 is a schematic block diagram of a speech communication system depicting the use of speech encoding and decoding. The speech communication system supports transmission and reproduction of a speech signal across a communication channel 905. Although it may comprise, for example, a wire, optical or fiber link, the communication channel 905 typically comprises at least in part a radio frequency link. The radio frequency link often supports multiple, simultaneous speech communications requiring shared bandwidth resources such as may be found with cellular telephony. Although not shown, the communication channel 905 may be replaced by a storage device in a single device embodiment of the communication system that records and stores the encoded speech signal for later playback.

Still referring to FIG. 27, a microphone 901 produces an analog speech signal that is supplied to an analog-to-digital (A/D) converter 902 for converting it into a digital form. A speech encoder 903 encodes the digital speech signal thereby producing a set of encoding parameters that are coded into a binary form and delivered to a channel encoder 904. The optional channel encoder adds redundancy to the binary representation of the coding parameters before transmitting them over the communication channel 905. On the receiver side, a channel decoder 906 utilizes the above mentioned redundant information in the received bit stream to detect and correct channel errors that have occurred in the transmission. A speech decoder 907 converts the bit stream received from the channel decoder 906 back to a set of encoding parameters for creating a synthesized digital speech signal. The synthesized digital speech signal reconstructed in the speech decoder 907 is converted to an analog form in a digital-to-analog (D/A) converter 908 and played back in a loudspeaker unit 909.

Short Background on CELP

A speech codec consists of two basic parts: an encoder and a decoder. The encoder digitizes the audio signal, chooses a limited number of encoding parameters representing the speech signal and converts these parameters into a digital bit stream that is transmitted to the decoder through a communication channel. The decoder reconstructs the speech signal to be as similar as possible to the original speech signal. Presently, a widespread speech encoding technique is based on Linear Prediction (LP), and more specifically on CELP technology. In LP-based coding, the speech signal is synthesized by filtering an excitation signal through an all-pole synthesis filter 1/A(z). In CELP, the excitation is typically composed of two parts, a first stage excitation signal is selected from an adaptive codebook and a second stage excitation signal is selected from a fixed codebook. Generally speaking, the adaptive codebook excitation models the periodic part of the excitation and the fixed codebook excitation is added to model the evolution of the speech signal.

The speech is normally processed by frames of typically 20 ms and the LP filter coefficients are transmitted once per frame. In CELP, every frame is further divided in several subframes to encode the excitation signal. The subframe length is typically 5 ms.

Referring to FIGS. 1*a* and 1*b*, the main principle behind CELP is called Analysis-by-Synthesis where possible decoder outputs are tried (synthesis) already during the encoding process (analysis) and then compared to the original speech signal. The search minimizes a mean-squared error between the input speech signal s(n) and the synthesized speech signal s'(n) in a perceptually weighted domain, where discrete time index n=0, 1, . . . , N−1, and N is the length of the subframe. The perceptual weighting filter W(z) exploits the frequency masking effect and is typically derived from the LP filter. An example of perceptual weighting filter W(z) is given in the following Equation (1):

$$W(z) = \frac{A(z/\gamma_1)}{A(z/\gamma_2)}, \tag{1}$$

where factors $\gamma_1$ and $\gamma_2$ control the amount of perceptual weighting and holds the relation $0<\gamma_2<\gamma_1\leqq 1$. This traditional perceptual weighting filter works well for NB (narrowband-bandwidth of 200-3400 Hz) signals. An example of perceptual weighting filter for WB (wideband-bandwidth of 50-7000 Hz) signals can be found in Reference [1].

The bit stream transmitted to the decoder contains for the voiced frames the following encoding parameters: the quantized parameters of the LP synthesis filter, the adaptive and fixed codebook indices and the gains of the adaptive and fixed parts.

Adaptive Codebook Search

The adaptive codebook search in CELP-based codecs is performed in weighted speech domain to determine the delay (pitch period) t and the pitch gain $g_p$, and to construct the quasi-periodic part of the excitation signal referred to as adaptive codevector v(n). The pitch period is strongly dependent on the particular speaker and its accurate determination critically influences the quality of the synthesized speech.

In a EV-VBR codec, a three-stage procedure is used to determine the pitch period and gain. In the first stage, three open-loop pitch estimates $T_{op}$ are computed for each frame—one estimate for each 10 ms half-frame and one for a 10 ms look-ahead—using the perceptually weighted speech signal $s_w(n)$ and normalized correlation computing. In the second stage, a closed-loop pitch search is performed for integer periods around the estimated open-loop pitch periods $T_{op}$ for every subframe. Once an optimum integer pitch period is found, a third search stage goes through the fractions around that optimum integer value. The closed-loop pitch search is performed by minimizing the mean-squared weighted error between the original and synthesized speech. This is achieved by maximizing the term $$\mathfrak{I}_t = \frac{\left(\sum_{n=0}^{N-1} x_1(n)y_1(n)\right)^2}{\sum_{n=0}^{N-1} y_1(n)y_1(n)}, \tag{2}$$

where $x_1(n)$ is the target signal and the first stage contribution signal (also called filtered adaptive codevector) $y_1(n)$ is computed by the convolution of the past excitation signal v(n) at period t with the impulse response h(n) of the weighted synthesis filter H(z)

$$y_1(n)=v(n)*h(n). \tag{3}$$

The perceptually weighted input speech signal $s_w(n)$ is obtained by processing the input speech signal s(n) through the perceptual weighting filter W(z). The filter H(z) is formed by the cascade of the LP synthesis filter 1/A(z) and the perceptual weighting filter W(z). The target signal $x_1(n)$ corresponds to the perceptually weighted input speech signal $s_w(n)$ after subtracting therefrom the zero-input response of the filter H(z).

The pitch gain is found by minimizing the mean-squared error between the signal $x_1(n)$ and the first stage contribution signal $y_1(n)$. The pitch gain is expressed by the following Equation:

$$g_p = \frac{\sum_{n=0}^{N-1} x_1(n)y_1(n)}{\sum_{n=0}^{N-1} y_1(n)y_1(n)}. \tag{4}$$

The pitch gain is then bounded by $0\leqq g_p\leqq 1.2$ and typically jointly quantized with the fixed codebook gain once the innovation is found.

In CELP-based codecs, the excitation signal in the beginning of the currently processed frame is thus reconstructed from the excitation signal from the previous frame. This mechanism is very efficient for voiced segments of the speech signal where the signal is quasi-periodic, and in absence of transmission errors. In case of frame erasure, the excitation signal from the previous frame is lost and the respective adaptive codebooks of the encoder and decoder are no longer the same. In frames following the erasure, the decoder then continues to synthesize the speech using the adaptive codebook with incorrect content. Consequently, a frame erasure degrades the synthesized speech quality not only during the erased frame, but it can also degrade the synthesized speech quality during several subsequent frames. The traditional concealment techniques are often based on repeating the waveform of the previous correctly-transmitted frame, but these techniques work efficiently only in the signal parts where the characteristics of the speech signal are quasi stationary, for example in stable voiced segments. In this case, the difference between the respective adaptive codebooks of the encoder and decoder are often quite small and the quality of the synthesized signal is not much affected. However, if the erasure falls in a transition frame, the efficiency of these techniques is very limited. In communication systems using CELP-based codecs, where the Frame Erasure Rate (FER) is typically 3% to 5%, the synthesized speech quality then drops significantly.

Even in clean channel transmission, the efficiency of the adaptive codebook is limited in transition frames; the CELP encoder makes use of the adaptive codebook to exploit the periodicity in speech that is low or missing during transitions whereby the coding efficiency runs down. This is the case of voiced onsets in particular where the past excitation signal and the optimal excitation signal for the current frame are correlated very weakly or not at all.

Fixed Codebook Search

The objective of the contribution of the Fixed (innovation) CodeBook (FCB) search in CELP-based codecs is to minimize the residual error after the use of the adaptive codebook, i.e.

$$\min_k \left\{ \sum_{n=0}^{N-1} [x_2(n) - g_c \cdot y_2^{(k)}(n)]^2 \right\}, \tag{5}$$

where $g_c$ is the fixed codebook gain, and the second stage contribution signal (also called as the filtered fixed codevector) $y_2^{(k)}(n)$ is the fixed codebook vector $c_k(n)$ convolved with h(n). The target signal $x_1(n)$ is updated by subtracting the adaptive codebook contribution from the adaptive codebook target to obtain:

$$x_2(n)=x_1(n)-g_p y_1(n). \tag{6}$$

The fixed codebook can be realized for example by using an algebraic codebook as described in Reference [2]. If $c_k$ denotes the algebraic code vector at index k, then the algebraic codebook is searched by maximizing the following criterion:

$$\mathcal{T}_k = \frac{(x_2^T y_2)^2}{y_2^T y_2} = \frac{(x_2^T H c_k)^2}{c_k^T H^T H c_k} = \frac{(d^T c_k)^2}{c_k^T \Phi c_k} = \frac{(C_k)^2}{E_k}, \tag{7}$$

where H is the lower triangular Toeplitz convolution matrix with diagonal h(0) and lower diagonals h(1), h(N−1). Vector $d=H^T x_2$ is the correlation between the updated target signal $x_2(n)$ and h(n) (also known as backward filtered target vector), and matrix $\Phi=H^T H$ is the matrix of correlations of h(n). The superscript $^T$ denotes matrix or vector transpose. Both d and Φ are usually computed prior to the fixed codebook search. Reference [1] discusses that, if the algebraic structure of the fixed codebook contains only a few non-zero elements, a computation of the maximization criterion for all possible indexes k is very fast. A similar procedure is used in the transition mode (TM) encoding technique as will be seen below.

CELP is believed to be otherwise well known to those of ordinary skill in the art and, for that reason, will not be further described in the present specification.

Frame Classification in the EV-VBR Codec

The frame classification in the EV-VBR codec is based on VMR-WB (Variable Rate Multi-Mode Wideband) classification as described in Reference [3]. VMR-WB classification is done with the consideration of the concealment and recovery strategy. In other words, any frame is classified in such a way that the concealment can be optimal if the following frame is missing, or that the recovery can be optimal if the previous frame was lost. Some of the classes used for frame erasure concealment processing need not be transmitted, as they can be deduced without ambiguity at the decoder. Five distinct classes are used, and defined as follows:

- UNVOICED class comprises all unvoiced speech frames and all frames without active speech. A voiced offset frame can be also classified as UNVOICED if its end tends to be unvoiced and the concealment designed for unvoiced frames can be used for the following frame in case it is lost.
- UNVOICED TRANSITION class comprises unvoiced frames with a possible voiced onset at the end. The voiced onset is however still too short or not built well enough to use the concealment designed for voiced frames. An UNVOICED TRANSITION frame can follow only a frame classified as UNVOICED or UNVOICED TRANSITION.
- VOICED TRANSITION class comprises voiced frames with relatively weak voiced characteristics. Those are typically voiced frames with rapidly changing characteristics (transitions between vowels) or voiced offsets lasting the whole frame. A VOICED TRANSITION frame can follow only a frame classified as VOICED TRANSITION, VOICED or ONSET.
- VOICED class comprises voiced frames with stable characteristics. A VOICED frame can follow only a frame classified as VOICED TRANSITION, VOICED or ONSET.
- ONSET class comprises all voiced frames with stable characteristics following a frame classified as UNVOICED or UNVOICED TRANSITION. Frames classified as ONSET correspond to voiced onset frames where the onset is already sufficiently well built for the use of the concealment designed for lost voiced frames. The concealment techniques used for a frame erasure following a frame classified as ONSET are in traditional CELP-based codecs the same as following a frame classified as VOICED, the difference being in the recovery strategy when a special technique can be used to artificially reconstruct the lost onset. According to the non-restrictive illustrative embodiment of the present invention, the TM coding technique is successfully used in this case.

Figure 2:
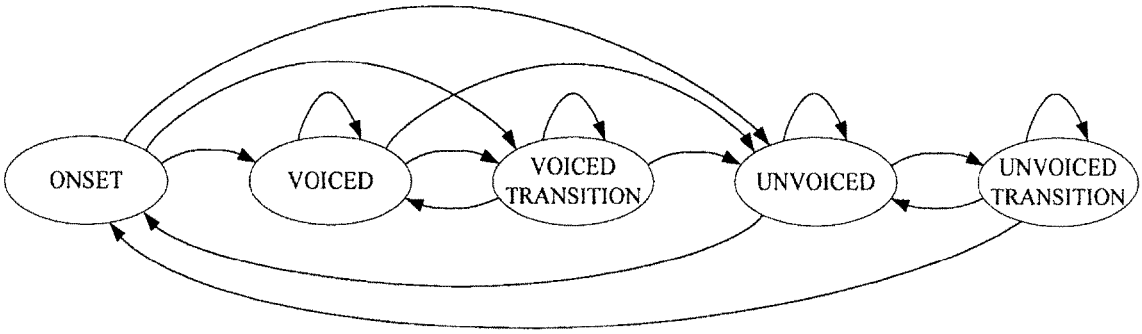
FIG. 2 is a schematic block diagram of a frame classification state machine for erasure concealment.

The classification state diagram is outlined in FIG. 2. The classification information is transmitted using 2 bits. As it can be seen from FIG. 2, the UNVOICED TRANSITION class and VOICED TRANSITION class can be grouped together as they can be unambiguously differentiated at the decoder (an UNVOICED TRANSITION frame can follow only UNVOICED or UNVOICED TRANSITION frames, a VOICED TRANSITION frame can follow only ONSET, VOICED or VOICED TRANSITION frames).

The following parameters are used for the classification: a normalized correlation $\overline{R}'_{xy}$, a spectral tilt measure $e'_t$, a pitch stability counter pc, a relative frame energy of the speech signal at the end of the current frame $E_{rel}$ and a zero-crossing counter zc. As can be seen in the following detailed analysis, the computation of these parameters uses a lookahead. The lookahead allows the evolution of the speech signal in the following frame to be estimated and, consequently, the classification can be done by taking into account the future speech signal behaviour.

The average normalized correlation $\overline{R}'_{xy}$ is computed as a mean of the maximum normalized correlation of the second half-frame and the lookahead using the following Equation:

$$\overline{R}'_{xy}=0.5(C_{norm}(d_1)+C_{norm}(d_2)). \tag{8}$$

The maximum normalized correlations $C_{norm}$ are computed as a part of the open-loop pitch search and correspond to the maximized normalized correlations of two adjacent pitch periods of the weighted speech signal.

The spectral tilt parameter $e'_t$ contains the information about the frequency distribution of energy. The spectral tilt for one spectral analysis is estimated as a ratio between the energy concentrated in low frequencies and the energy concentrated in high frequencies. Here, the tilt measure used is the average in the logarithmic domain of the spectral tilt measures $e_{tilt}(\mathbf{0})$ and $e_{tilt}(\mathbf{1})$ defined as a low and high frequency energies ratio. That is:

$$e'_t=10\log(e_{tilt}(0)e_{tilt}(1)). \tag{9}$$

The pitch stability counter pc assesses the variation of the pitch period. It is computed as follows:

$$pc=|T_{op1}-T_{op0}|+|T_{op2}-T_{op0}|. \tag{10}$$

The values $T_{op0}$, $T_{op1}$, and $T_{op2}$ correspond to the open-loop pitch estimates from the first half of the current frame, the second half of the current frame and the lookahead, respectively.

The relative frame energy $E_{rel}$ is computed as a difference in dB between the current frame energy and the long-term active-speech energy average.

The last parameter is the zero-crossing parameter zc computed on a 20 ms segment of the speech signal. The segment starts in the middle of the current frame and uses two subframes of the lookahead. Here, the zero-crossing counter zc counts the number of times the speech signal sign changes from positive to negative during that interval.

To make the classification more robust, the classification parameters are considered together forming a function of merit $f_m$. For that purpose, the classification parameters are first scaled between 0 and 1 so that parameter's value typical for unvoiced speech signal translates into 0 and each parameter's value typical for voiced speech signal translates into 1. A linear function is used between them. The scaled version $p^s$ of a certain parameter $p_x$ is obtained using the Equation:

$$p^s=k_p p_x+c_p \text{ constrained by } 0\leqq p^s\leqq 1. \tag{11}$$

The function coefficients $k_p$ and $c_p$ have been found experimentally for each of the parameters so that the signal distortion due to the concealment and recovery techniques used in presence of frame errors is minimal. The values used are summarized in Table 1.

TABLE 1

Signal Classification Parameters and the coefficients of their respective scaling functions.

| Parameter | Meaning | $k_p$ | $c_p$ |
|---|---|---|---|
| $\overline{R}'_{xy}$ | Normalized Correlation | 2.857 | −1.286 |
| $e'_t$ | Spectral Tilt | 0.04167 | 0 |
| pc | Pitch Stability counter | −0.07143 | 1.857 |
| $E_{rel}$ | Relative Frame Energy | 0.05 | 0.45 |
| zc | Zero Crossing Counter | −0.04 | 2.4 |

Then the function of merit $f_m$ has been defined as:

$$f_m=\frac{1}{6}(2\overline{R}^s_{xy}+e^s_t+pc^s+E^s_{rel}+zc_s), \tag{12}$$

where the superscript s indicates the scaled version of the parameters.

A first classification decision is made for the UNVOICED class as follows:

If (local_VAD=0) OR ($E_{rel}$<−8) then
class=UNVOICED. (13)

where local_VAD stands for local Voice Activity Detection.

If the above condition (13) is not satisfied, then the classification proceeds using the function of merit $f_m$ and following the rules summarized in Table 2.

TABLE 2

Signal Classification Rules at the Encoder.

| Previous Frame Class | Rule | Current Frame Class |
|---|---|---|
| ONSET | $f_m \geqq 0.66$ | VOICED |
| VOICED | $0.66 > f_m \geqq 0.49$ | VOICED TRANSITION |
| VOICED TRANSITION | $f_m < 0.49$ | UNVOICED |
| UNVOICED TRANSITION | $f_m > 0.63$ | ONSET |
| UNVOICED | $0.63 \geqq f_m > 0.585$ | UNVOICED TRANSITION |
| | $f_m \leqq 0.585$ | UNVOICED |

The class information is encoded with two bits as explained herein above. Despite the fact that the supplementary information, which improves frame erasure concealment, is transmitted only in Generic frames, the classification is performed for each frame. This is needed to maintain the classification state machine up to date as it uses the information about the class of the previous frame. The classification is however straightforward for encoding types dedicated to UNVOICED or VOICED frames. Hence, voiced frames are always classified as VOICED and unvoiced frames are always classified as UNVOICED.

Frame Selection for TM Coding

As discussed previously, the technique being described replaces the adaptive codebook in CELP-based coders by a glottal-shape codebook to improve the robustness to frame erasures and to enhance the coding efficiency when non-stationary speech frames are processed. This means that this technique does not construct the first stage excitation signal with the use of the past excitation, but selects the first stage excitation signal from the glottal-shape codebook. The second stage excitation signal (the innovation part of the total excitation) is still selected from the traditional CELP fixed codebook. Any of these codebooks use no information from the past (previously transmitted) speech frames, thereby eliminating the main reason for frame error propagation inherent to CELP-based encoders.

Using the TM coding technique systematically (to encode all frames) would greatly limit the error propagation, but the coding efficiency and the synthesized speech quality would drop in error-free conditions. As a compromise between the clean-channel performance of the codec and its robustness to channel errors, the TM coding technique can be applied only to the transition frames and to several frames following each transition frame. For frame erasure robustness, the TM coding technique can be used for voiced speech frames following transitions. As introduced previously, these transitions comprise basically the voiced onsets and the transitions between two different voiced sounds. To select pertinent frames to be encoded using the TM coding technique, transitions are detected. While any detector of transitions can be used, the non-restrictive illustrative embodiment uses the classification of the EV-VBR framework as described herein above.

The TM coding technique can be applied to encode transition (voiced onset or transition between two different voiced sounds) frames as described above and several subsequent frames. The number of TM frames (frames encoded using the TM coding technique) is a matter of compromise between the codec performance in clean-channel conditions and in conditions with channel errors. If only the transition (voiced onset or transition between two different voiced sounds) frames are encoded using the TM coding technique, the encoding efficiency increases. This increase can be measured by the increase of the segmental signal-to-noise ratio (SNR), for example. The SNR is computed using the following Equation:

$$SNR = \frac{E_{sd}}{E_e}, \tag{14}$$

where $E_{sd}$ is the energy of the input speech signal of the current frame and $E_e$ is the energy of the error between this input speech signal and the synthesis speech signal of the current frame.

However, using the TM coding technique to encode only the transition frames does not help too much for error robustness; if the transition (voiced onset or transition between two different voiced sounds) frame is lost, the error will propagate as the following frames would be coded using the standard CELP procedure. On the other hand, if the frame preceding the transition (voiced onset or transition between two different voiced sounds) frame is lost, the effect of this lost preceding frame on the performance is not critical even without the use of the TM coding technique. In the case of voiced onset transitions, the frame preceding the onset is likely to be unvoiced and the adaptive codebook contribution is not much important. In the case of a transition between two voiced sounds, the frame before the transition is generally fairly stationary and the adaptive codebook state in the encoder and the decoder are often similar after the frame erasure.

Figure 3:
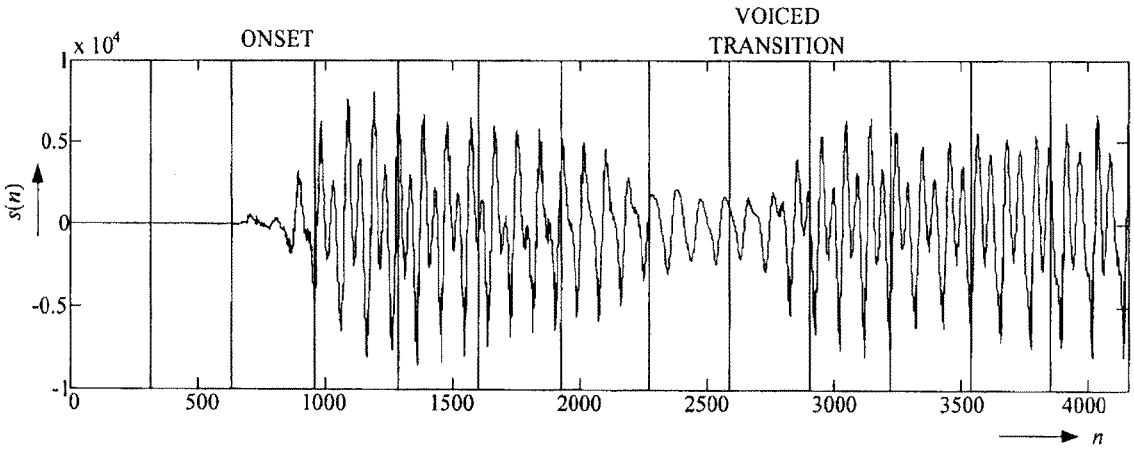
FIG. 3 is an example of segment of a speech signal with one voiced transition frame and one onset frame.

To increase the robustness, frames following the transition (voiced onset or transition between two different voiced sounds) can be encoded using the TM coding technique. If the clean-channel performance enhancement is not important, the TM coding technique can be used only in the frames following the transition frames. Basically, the number of consecutive TM frames depends on the number of consecutive frame erasures one wants to consider for protection. If only isolated erasures are considered (i.e. one isolated frame erasure at a time), it is sufficient to encode only the frame following the transition (voiced onset or transition between two different voiced sounds) frame. If the transition (voiced onset or transition between two different voiced sounds) frame is lost, the following frame is encoded without the use of the past excitation signal and the error propagation is broken. It should be pointed out, however, that if the transition (voiced onset or transition between two different voiced sounds) frame is transmitted correctly but the following frame is lost, the error propagation would not be prevented as the next frame is already using classical CELP encoding. However, the distortion will likely be limited if at least one pitch period is already well built at the end of the transition (voiced onset or transition between two different voiced sounds) as shown in FIG. 3.

Figure 4:
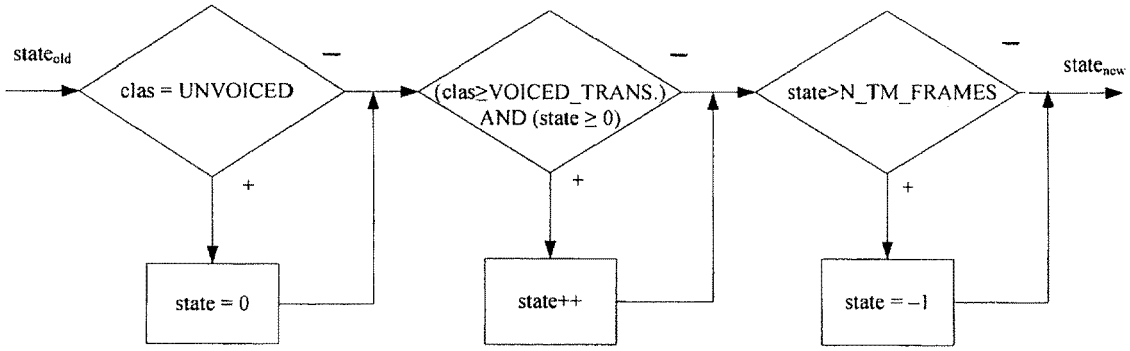
FIG. 4 is a functional block diagram illustrating a classification rule to select TM (Transition Mode) frames in speech onsets, where N_TM_FRAMES stands for a number of consecutive frames to prevent using a TM coding technique, 'clas' stands for a frame class, and VOICED_TYPE means ONSET, VOICED and VOICED TRANSITION classes.

When an implementation of the TM coding technique is done into some existing codec and the class of the current frame and the coding mode are known, the following scheme to set the onset and the following frames for TM coding can be used. A parameter state that is a counter of the consecutive TM frames previously used is stored in the encoder state memory. If the value of this parameter state is negative, TM coding cannot be used. If the parameter state is not negative but lower or equal to the number of consecutive frame erasures to protect, and the class of the frame is ONSET, VOICED or VOICED TRANSITION, the frame is denoted as TM frame (see FIG. 4 for more detail). In other words, the frame is denoted as TM frame if N_TM_FRAMES≧state>0, where N_TM_FRAMES is a number of consecutive frames to prevent using the TM coding technique.

If it is expected that the communication channel characteristics are such that more than one isolated frame are often erased at a time, i.e. that the frame erasures have the tendency to appear in bundles, the best solution might be to use the TM coding technique to protect two or even more consecutive frame erasures. However, the coding efficiency in clean-channel conditions will drop. If a feedback about the channel is available in the encoder, the number of the consecutive TM frames might be made adaptive to the conditions of transmission. In the non-restrictive illustrative embodiment of the present invention, up to two TM frames following the transition (voiced onset or transition between two different voiced sounds) frame are considered, which corresponds to a design able to cope with up to two consecutive frame erasures.

The above described decision uses basically a fixed number (whether this number is fixed before the transmission or is dependent on channel conditions of transmission) of TM frames following the transition (voiced onset or transition between two different voiced sounds) frame. The compromise between the clean-channel performance and the frame-error robustness can be also based on a closed-loop classification. More specifically, in the frame that one wants to protect against the previous frame erasure or wants to decide if it is the onset frame, a computation of the two possible coding modes is done in parallel; the frame is processed both using the generic (CELP) coding mode and the TM coding technique. Performance of both approaches is then compared using a SNR measure, for example; for more details the following Section entitled "TM coding Technique Performance in EV-VBR Codec". When the difference between the SNR for the generic (CELP) coding mode and the SNR for the TM coding technique is greater than a given threshold, the generic (CELP) coding mode is applied. If the difference between the SNR for the generic (CELP) coding mode and the SNR for the TM coding technique is smaller than the given threshold, the TM coding technique is applied. The value of the threshold is chosen depending on how strong the frame erasure protection and onset coding determination is required.

Subframe Selection for Glottal-Shape Codebook Search

In the previous Section, the reasons and mechanisms for selecting frames for coding using the TM coding technique was described. Now it will be shown that it is generally more efficient not to use the glottal-shape codebook in all subframes in order to achieve the best compromise between the clean-channel performance at a given bitrate and the performance in presence of an erasure in the frames preceding the TM frames. First, the glottal-shape codebook search is important only in the first pitch-period in a frame. The following pitch periods can be encoded using the more efficient standard adaptive codebook search since they no longer use the excitation of the past frame (when the adaptive codebook is searched, the excitation is searched up to about one pitch period in the past). There is consequently no reason to employ the glottal-shape codebook search in subframes containing no portion of the first pitch period of a frame.

Similarly, when the glottal-shape codebook search is used to increase the encoding efficiency in voiced onset frames, this glottal-shape codebook search is used on the first pitch period of the starting voiced segment. The reason is that for the first pitch period, the adaptive codebook contains a noise-like signal (the previous segment was not voiced) and replacing it with a quantized glottal impulse often increases the coding efficiency. For the following pitch periods however, the periodic excitation has already built up in the adaptive codebook and using this codebook will yield better results. For this reason, the information on the voiced onset position is available at least with subframe resolution.

Further optimization of the bit allocation concerns frames with pitch periods longer than the subframe length. Given that the glottal-shape codebook contains quantized shapes of the glottal impulse, the codebook is best suited to be used in subframes containing the glottal impulse. In other subframes, its efficiency is low. Given that the bit rate is often quite limited in speech encoding applications and that the encoding of the glottal-shape codebook requires a relatively larger number of bits for low bit rate speech encoding, a bit allocation where the glottal-shape codebook is used and searched only in one subframe per frame was chosen in the non-restrictive, illustrative embodiment.

To choose the subframe to be encoded with the glottal-shape codebook, the first glottal impulse in the LP residual signal is looked for. The following simple procedure can be used. The maximum sample in the LP residual signal is searched in the range $[0, 0+T_{op}+2]$, where $T_{op}$ is the open-loop pitch period for the first half-frame and 0 corresponds to the frame beginning. In the case of voiced onset frames, and if the beginning of the onset can be reliably determined, 0 denotes the beginning of the subframe where the onset beginning is located. The glottal-shape codebook will be then employed in the subframe with the maximum residual signal energy. Moreover the position of the maximum gives information where the glottal impulse position can approximately be situated and this situation can be exploited for complexity reduction as will be discussed later. Note that as the glottal-shape codebook search replaces only the adaptive codebook search, a fixed codebook search is done in every subframe of a TM frame.

Figure 5:
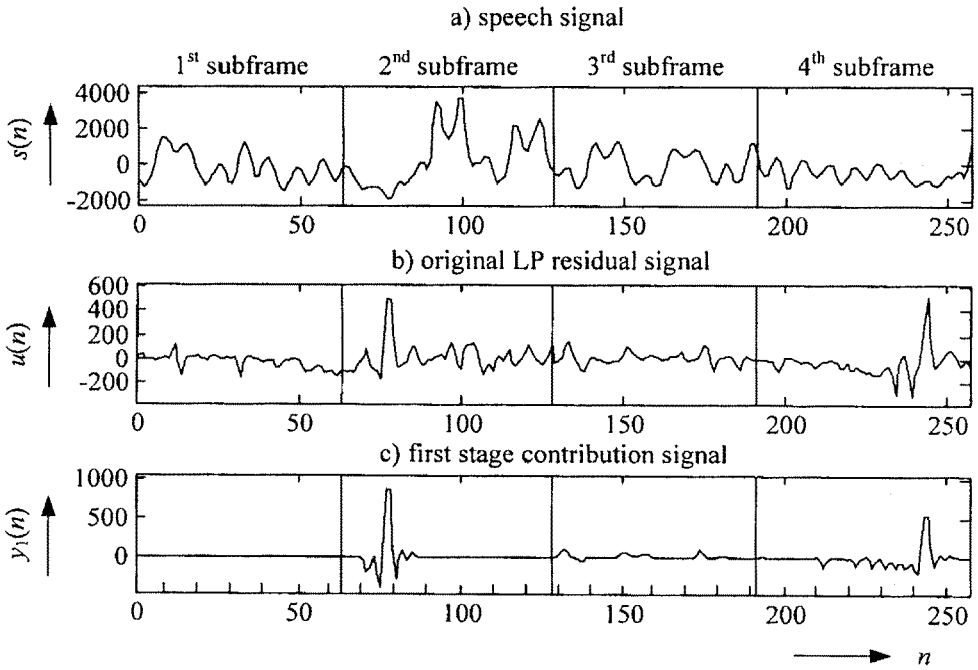
FIG. 5*a* is a schematic illustration of an example of frame of a speech signal divided into four (4) subframes, showing the speech signal in the time domain.
FIG. 5*b* is a schematic illustration of an example of frame of a speech signal divided into four (4) subframes, showing a LP residual signal.
FIG. 5*c* is a schematic illustration of an example of frame of a speech signal divided into four (4) subframes, showing a first stage excitation signal constructed using the TM coding technique in the encoder.

The other subframes (not encoded with the use of the glottal-shape codebook) will be processed as follows. If the subframe using glottal-shape codebook search is not the first subframe in the frame, the excitation signal in preceding subframe(s) of the frame is encoded using the fixed CELP codebook only; this means that the first stage excitation signal is zero. If the glottal-shape codebook subframe is not the last subframe in the frame, the following subframe(s) of the frame is/are processed using standard CELP encoding (i.e. using the adaptive and the fixed codebook search). In FIGS. 5*a*-5*c*, the situation is shown for the case where the first glottal impulse emerges in the 2nd subframe. In FIG. 5*b*, u(n) is the LP residual signal. The first stage excitation signal is denoted $q_k(n)$ when it is built using the glottal-shape codebook, or v(n) when it is built using the adaptive codebook. In this example (FIG. 5*c*), the first stage excitation signal is zero in the $1^{st}$ subframe, it is a glottal-shape codevector in the $2^{nd}$ subframe and a adaptive codebook vector in the last two subframes.

In order to further increase coding efficiency and to optimize bit allocation, different processing is used in particular subframes of a TM frame dependent on the pitch period. When the first subframe is chosen as TM subframe, the subframe with the $2^{nd}$ glottal impulse in the LP residual signal is determined. This determination is based on the pitch period value and the following four situations then can occur. In the first situation, the $2^{nd}$ glottal impulse is in the $1^{st}$ subframe, and the $2^{nd}$ $3^{rd}$ and $4^{th}$ subframes are processed using standard CELP encoding (adaptive and fixed codebook search). In the second situation, the $2^{nd}$ glottal impulse is in the $2^{nd}$ subframe, and the 2nd, 3rd and 4th subframes are processed using again standard CELP encoding. In the third situation, the $2^{nd}$ glottal impulse is in the $3^{rd}$ subframe. The $2^{nd}$ subframe is processed using fixed codebook search only as there is no glottal impulse in the $2^{nd}$ subframe of the LP residual signal to be searched for using the adaptive codebook. The $3^{rd}$ and $4^{th}$ subframes are processed using standard CELP encoding. In the last (fourth) situation, the $2^{nd}$ glottal impulse is in the $4^{th}$, subframe (or in the next frame), the $2^{nd}$ and $3^{rd}$ subframes are processed using the fixed codebook search only, and the $4^{th}$, subframe is processed using standard CELP encoding. More detailed discussion is provided in an exemplary implementation later below.

Table 3 shows names of the possible coding configurations and their occurrence statistics. In other words, Table 3 gives the distribution of the first and the second glottal impulse occurrence in each subframe for frames processed with the TM coding technique. Table 3 corresponds to the scenario where the TM coding technique is used to encode only the voiced onset frame and one subsequent frame. The frame length of the speech signal in this experiment was 20 ms, the subframe length 5 ms and the experiment was conducted using voices of 32 men and 32 women (if not mentioned differently, the same speech database was used also in all other experiments mentioned in the following description).

TABLE 3

Coding mode configurations for TM and their occurrence when speech signal is processed.

| Coding configuration | Position(s) of the first (and the second if relevant) glottal impulse(s) | type of codebook used (GS = glottal-shape, A = adaptive, F = fixed) 1st subfr. | 2nd subfr. | 3rd subfr. | 4th subfr. | Quantity [%] |
|---|---|---|---|---|---|---|
| TRANSITION_1_1 | | GS + F | A + F | A + F | A + F | 25.5 |
| TRANSITION_1_2 | | GS + F | A + F | A + F | A + F | 28.4 |
| TRANSITION_1_3 | | GS + F | F | A + F | A + F | 16.3 |
| TRANSITION_1_4 | | GS + F | F | F | A + F | 3.0 |
| TRANSITION_2 | | F | GS + F | A + F | A + F | 21.2 |
| TRANSITION_3 | | F | F | GS + F | A + F | 4.6 |
| TRANSITION_4 | | F | F | F | GS + F | 1.0 |

Glottal-Shape Codebook

In principle, the glottal-shape codebook consists of quantized normalized shapes of the glottal impulses placed at a specific position. Consequently, the codebook search consists both in the selection of the best shape, and in the determination of its best position in a particular subframe. In its simplest form, the shape of the glottal impulse can be represented by a unity impulse and does not need to be quantized. In that case, only its position in the subframe is determined. However the performance of such a simple codebook is very limited.

On the other hand, the best representation would be probably achieved if the length L of the glottal-shape codebook entries corresponds to the length of the pitch period, and if a large number of glottal impulse shapes are represented. As the length and the shape of the glottal impulses vary from speaker to speaker and from frame to frame, the complexity and memory requirements to search and store such a codebook would be too extensive. As a compromise, the length of the glottal impulses as well as their number must be limited. In the non-restrictive illustrative embodiment, the glottal-shape codebook is composed of eight (8) different glottal impulse shapes and the length of each glottal impulse is L=17 samples. The quantized shapes have been selected such that the absolute maximum is around the middle of this length. During the glottal-shape codebook search, this middle is aligned with the index k' which represents the position of the glottal impulse in the current subframe and is chosen from the interval [0, N−1], N being the subframe length. As the codebook entries length of 17 samples is shorter than the subframe length, the remaining samples are set to zero.

Figure 6:
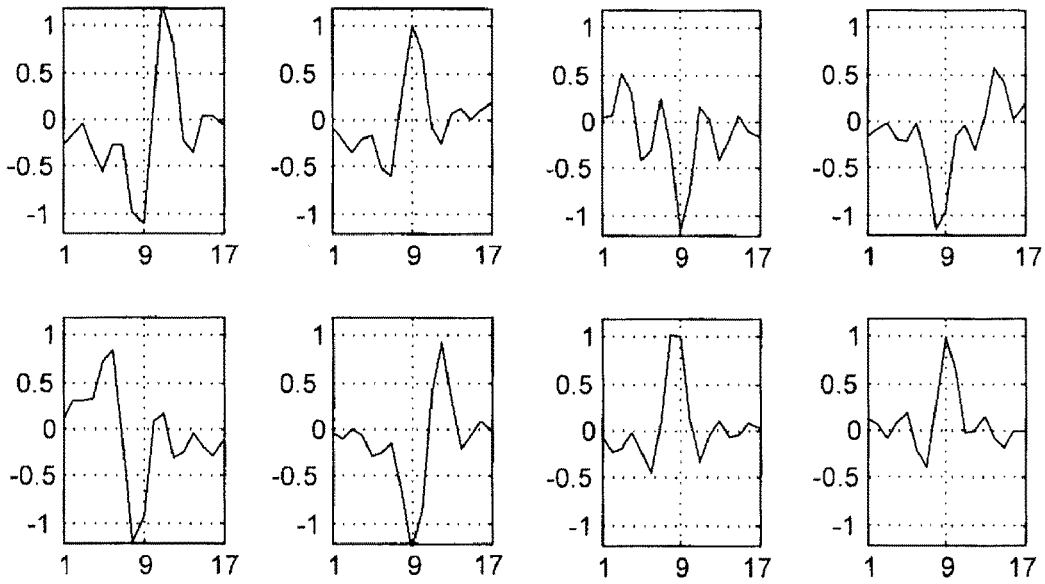
FIG. 6 show graphs illustrating eight glottal impulses with 17-sample length used for the glottal-shape codebook construction, wherein the x-axis denotes a discrete time index and the y-axis an amplitude of the impulse.

The glottal-shape codebook is designed to represent as many existent glottal impulses as possible. A training process based on the k-means algorithm [4] was used; the glottal-shape codebook was trained using more than three (3) hours of speech signal composed of utterances of many different speakers speaking in several different languages. From this database, the glottal impulses have been extracted from the LP residual signal and truncated to 17 samples around the maximum absolute value. From the sixteen (16) shapes selected by the k-means algorithm, the number of shapes has been further reduced to eight (8) shapes experimentally using a segmental SNR quality measure. The selected glottal-shape codebook is shown in FIG. 6. Obviously, other means can be used to design the glottal-shape codebook.

Glottal-Shape Codebook Search

The actual realization of the glottal-shape codebook can be done in several ways. For example, the search can be performed similar to the fixed codebook search in CELP. In this case the codebook is constructed by placing the center of the glottal impulse shapes at all possible positions in the subframe. For instance, for a subframe length of sixty-four (64) samples and eight (8) glottal impulse shapes, a glottal-shape codebook of size 64×8=512 codevectors is obtained. In accordance with another example, similarly to the adaptive codebook search, the codebook entries can be successively placed at all potential positions in the past excitation and the best shape/position combination can be selected in a similar way as is used in the adaptive codebook search. In the latter realization all pitch cycle repeating is automatically done through the long-term CELP filter and the glottal impulses are represented with full-sized shapes (in contrast to the first realization where glottal-shape truncation is necessary in border cases as will be discussed later).

The non-restrictive illustrative embodiment uses the configuration where the codebook search is similar to the fixed codebook search in Algebraic CELP (ACELP). In this approach, for each of the candidate shapes, the shape is represented as an impulse response of a shaping filter G(z). Thus the codevectors corresponding to glottal impulse shapes centered at different positions can be represented by codevectors containing only one non-zero element filtered through the shaping filter G(z) (for a subframe size N there are N single-pulse vectors for potential glottal impulse positions k).

Because of the glottal impulse position k' is in the middle of the glottal shape with an odd length of L samples and k' is from the range [0, N−1], the glottal shape must be truncated for the first and for the last $L_{1/2}=(L-1)/2$ samples. This will be taken into consideration during the glottal pulse search since it makes the shaping filter G(z) a non-causal filter.

Figure 7:
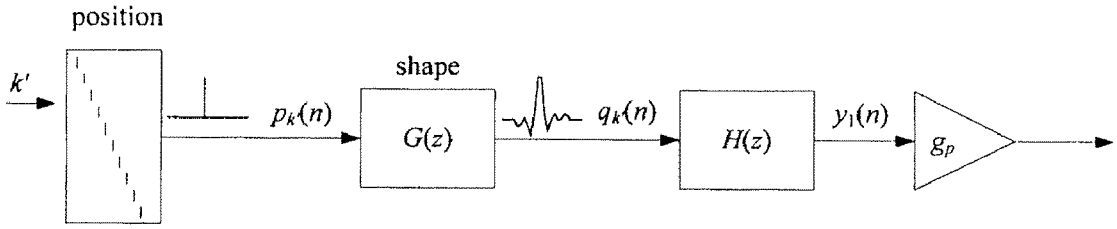
FIG. 7 is a schematic block diagram of an example of TM portion of a CELP encoder, where k' represents a glottal-shape codebook index and G(z) is a shaping filter.
Figure 11:
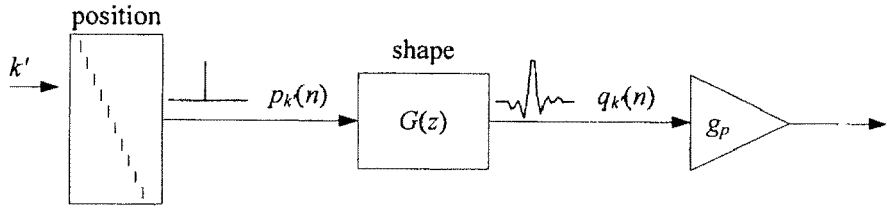
FIG. 11 is a schematic block diagram of an example of TM portion of a CELP decoder.

The configuration of the TM part is shown in FIG. 7 for the encoder and in FIG. 11 for the decoder. As already mentioned, the TM part replaces the adaptive codebook part of the encoder/decoder. During the search, the impulse response of the shaping filter G(z) can be integrated to the impulse response of the filter H(z).

A procedure and corresponding codebook searcher for searching the optimum glottal impulse center position k' for a certain shape of the glottal impulse rendered by the shaping filter G(z) will now be described. Because the shape of the filter G(z) is chosen from several candidate shapes (eight (8)

shapes are used in the non-restrictive illustrative embodiment as illustrated in FIG. 6), the search procedure must be repeated for each glottal shape of the codebook in order to find the optimum impulse shape and position.

To determine TM coding parameters, the search determines the mean-squared error between the target vector $x_1$ and the glottal-shape codevector centered at position k' that is filtered through the weighted synthesis filter H(z). Similar to CELP, the search can be performed by finding the maximum of a criterion in the form:

$$\mathfrak{I}_{k'} = \frac{(x_1^T y_1)^2}{y_1^T y_1} \tag{15}$$

where $y_1$ is the filtered glottal-shape codevector. Let $a_{k'}$ denote the glottal-shape codevector centered at position k' and $p_{k'}$ a position codevector with one (1) non-zero element indicating the position k', then $q_{k'}$ can be written as $q_{k'}=G\cdot p_{k'}$, where G is a Toeplitz matrix representing the shape of the glottal impulse. Therefore, similar to the fixed codebook search, the following Equation can be written:

$$\begin{aligned}\mathfrak{I}_{k'} &= \frac{(x_1^T y_1)^2}{y_1^T y_1} \\ &= \frac{(x_1^T H q_{k'})^2}{q_{k'}^T H^T H q_{k'}} \\ &= \frac{(x_1^T H G p_{k'})^2}{p_{k'}^T G^T H^T H G p_{k'}} \\ &= \frac{(x_1^T Z p_{k'})^2}{p_{k'}^T Z^T Z p_{k'}} \\ &= \frac{(d_g^T p_{k'})^2}{p_{k'}^T \Phi_g p_{k'}} \\ &= \frac{(C_{k'})^2}{E_{k'}},\end{aligned} \tag{16}$$

where H is the lower triangular Toeplitz convolution matrix of the weighted synthesis filter. As will be discussed later, the rows of the matrix $Z^T$ correspond to the filtered shifted version of the glottal impulse shape or its truncated representation. Note that all vectors in this text are supposed column vectors (N×1 matrices).

An example of matrix G in transpose form ($^T$) for an impulse length of three (3) samples and N=4 would have the form:

$$G^T = \begin{bmatrix} g(0) & g(1) & 0 & 0 \\ g(-1) & g(0) & g(1) & 0 \\ 0 & g(-1) & g(0) & g(1) \\ 0 & 0 & g(-1) & g(0) \end{bmatrix}, \tag{17}$$

where g(n) are the coefficients of the impulse response of the non-causal shaping filter G(z). In the following description, the coefficients of the non-causal shaping filter G(z) are given by the values g(n), for n located within the range $[-L_{1/2}, L_{1/2}]$. Because of the fact that the position codevector $p_{k'}$ has only one non-zero element, the computation of the criterion (16) is very simple and can be expressed using the following Equation:

$$\mathfrak{I}_{k'} = \frac{(d_g(k'))^2}{\Phi_g(k', k')}. \tag{18}$$

As it can be seen from Equation (18), only the diagonal of the matrix $\Phi_g$ needs to be computed.

Figure 8:
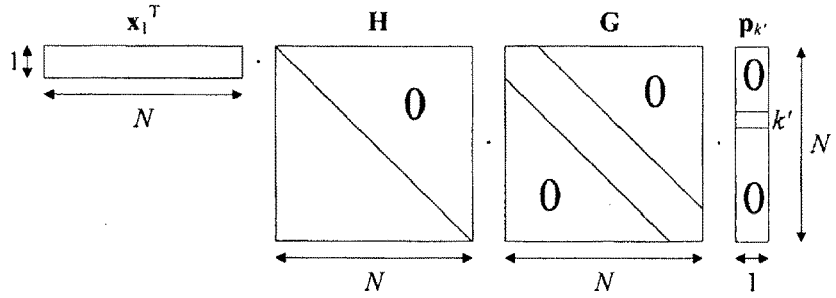
FIG. 8 is a graphical representation of the computation of Ck', the square root of the numerator in the criterion of Equation (16), wherein shaded portions of the vector/matrix are non-zero.
Figure 9:
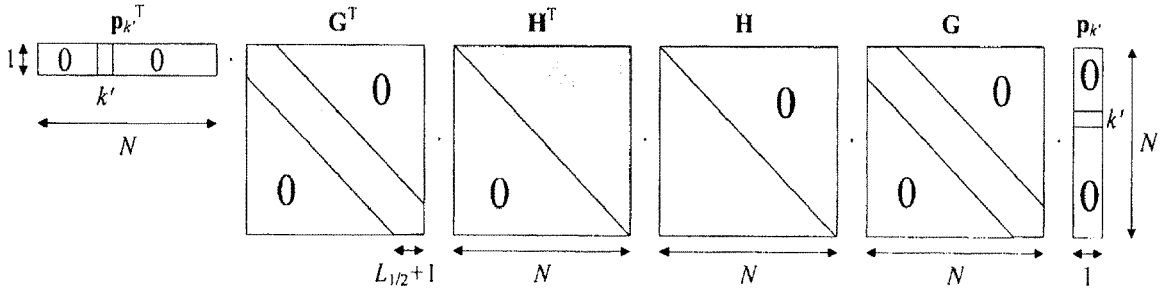
FIG. 9 is a graphical representation of the computation of Ek', the denominator of the criterion of Equation (16)), wherein shaded portions of the vector/matrix are non-zero.

A graphical representation of computing the criterion (18) for one glottal-shape codevector is shown in FIGS. 8 and 9. As it has been already mentioned, the Equation (18) is typically used in the ACELP algebraic codebook search by precomputing the backward filtered target vector $d_g$ and the correlation matrix $\Phi_g$. However, given the non-causal nature of the shaping filter G(z), this cannot be directly applied for the first $L_{1/2}$ positions. In these situations a more sophisticated search is used where some computed values can still be reused to maintain the complexity at a low level. This will be described hereinafter.

Let us denote $z_{k'}$ to be the $(k'+1)^{th}$ row of the matrix $Z^T$, where the matrix $Z^T$ (FIG. 10) is computed as follows. Given the non-causal nature of the shaping filter G(z), the matrix $Z^T$ is computed in two stages to minimize the computational complexity. The first $L_{1/2}+1$ rows of this matrix are first computed. For the remaining part of the matrix $Z^T$ (the last $N-L_{1/2}-1$ rows of the matrix $Z^T$), the criterion (18) is used in a manner similar to the ACELP fixed codebook search.

A detailed description of how to compute the matrix $Z^T$ and the criterion (18) will now be described.

In the first stage, the first $L_{1/2}+1$ rows of the matrix $Z^T$ that correspond to the positions k' within the range $[0, L_{1/2}]$ are computed. For these positions a different truncated glottal shape is used for each position k' within this range. In a first operation, a convolution between the glottal-shape response for position k'=0 and the impulse response h(n) is computed using the Equation:

$$z_0(n) = \sum_{i=0}^{n} g(n-i)h(i), \tag{19}$$

where advantage is taken of the fact that the shaping filter G(z) has only $L_{1/2}+1$ non-zero coefficients, i.e. g(0), g(1), . . . , $g(L_{1/2})$ are non-zero coefficients.

Figure 10:
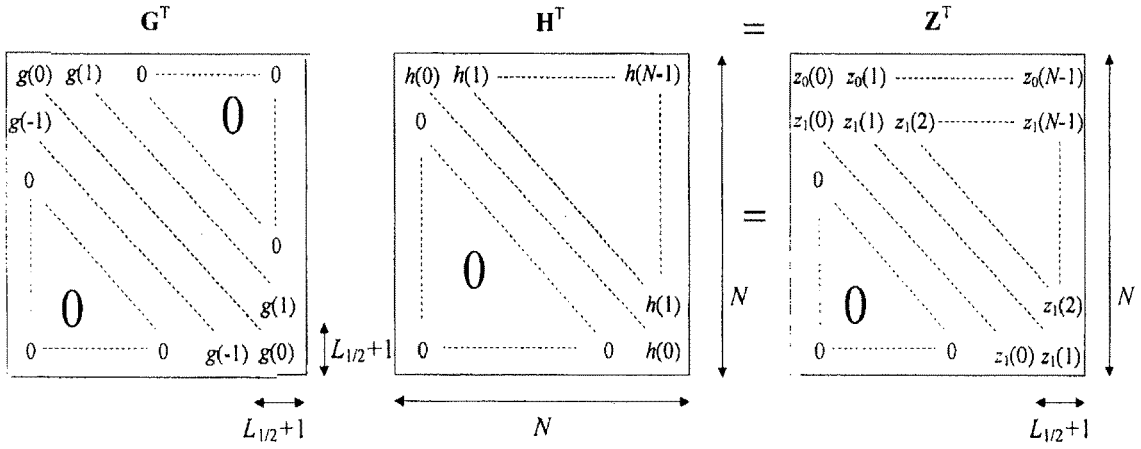
FIG. 10 is a graphical representation of the computation of the convolution matrix $Z^T$; in this example the shaping filter G(z) has only three (3) non-zero coefficients ($L_{1/2}=1$)

In a second operation, the convolution $z_1(n)$ between the glottal-shape codebook response for position k'=1 and the impulse response H(z) is computed reusing values of $Z_0(n)$ as follows (the matrix $Z^T=G^T\cdot H^T$ is a matrix with some zero negative-sloping diagonals, but this matrix $Z^T$ is no longer a Toeplitz and triangular matrix as shown in FIG. 10):

$$z_1(0)=g(-1)h(0)$$

$$z_1(n)=z_0(n-1)+g(-1)h(n) \text{ for } n=1, \ldots, N-1. \tag{20}$$

For the following rows, the recursion in Equation (21) is reused:

$$z_{k'}(0)=g(-k')h(0)$$

$$z_{k'}(n)=z_{k'-1}(n-1)+g(-k')h(n) \text{ for } n=1, \ldots, N-1 \tag{21}$$

The recursion (21) is repeated for all $k' \leqq L_{1/2}$. For $k'=L_{1/2}$ the shaping filter G(z) has already L non-zero coefficients and the $(L_{1/2}+1)^{th}$ row of the matrix $Z^T$ is thus obtained by $$z_{L_{1/2}}(0)=g(-L_{1/2})h(0)$$

$$z_{L_{1/2}}(n)=z_{L_{1/2}-1}(n-1)+g(-L_{1/2})h(n) \text{ for } n=1, \ldots, N-1. \tag{22}$$

At this point, the first $L_{1/2}+1$ rows of the matrix $Z^T$ have been computed. These rows comprise no zero coefficients (FIG. 10). Then the criterion (18) can be computed for k' within the range $[0, L_{1/2}]$ using the Equation:

$$\mathfrak{I}_{k'} = \frac{\left(\sum_{i=0}^{N-1} z_{k'}(i)\cdot x_1(i)\right)^2}{\sum_{i=0}^{N-1} z_{k'}(i)\cdot z_{k'}(i)}. \tag{23}$$

In the second stage the rest of the matrix $Z^T$ is computed and the criterion (18) is evaluated for positions k' within the range $[L_{1/2}+1, N-1]$. Advantage is taken of the fact that rows $L_{1/2}+1, \ldots, N-1$ of the matrix $Z^T$ are built using coefficients of the convolution $z_{L_{1/2}}(n)$ that have already been computed as described by the equation (22). The difference is that only a part of the coefficients is needed to compute these rows. That is, each row corresponds to the previous row shifted to the right by 1 and adding a zero at the beginning:

$$z_k(0)=0$$

$$z_k(n)=z_{k'-1}(n-1) \text{ for } n=1, \ldots, N-1. \tag{24}$$

This is repeated for k' within the range $[L_{1/2}+1, N-1]$.

In this second stage, the criterion (18) can be computed in a manner similar to that described in the above section Fixed codebook search to further reduce the computational complexity. The criterion (18) is first evaluated for the last position k'=N−1 (this is the last row of the matrix $Z^T$). For k'=N−1 the numerator and the denominator of the criterion (18) is provided by the following Equation $$d_g(N-1) = \sum_{i=0}^{L_{1/2}} x(N-1-L_{1/2}+i)z_{L_{1/2}}(i), \tag{25}$$

and $$\Phi_g(N-1, N-1) = \sum_{i=0}^{L_{1/2}} z_{L_{1/2}}(i)z_{L_{1/2}}(i). \tag{26}$$

Since some of the coefficients of the matrix $Z^T$ are zeros (FIG. 10), only $L_{1/2}+1$ multiplications (instead of the N multiplications as used in Equation (23)) are used to compute the numerator and the denominator of the criterion (18).

When using the example of FIG. 10 ($L_{1/2}=1$) the criterion (18), computed using equations (25) and (26), can be simplified as follows:

$$\mathfrak{I}_{N-1} = \frac{(d_g(N-1))^2}{\Phi_g(N-1, N-1)} = \frac{\left(x(N-2)z_{L_{1/2}}(0) + x(N-1)z_{L_{1/2}}(1)\right)^2}{z_{L_{1/2}}(0)z_{L_{1/2}}(0) + z_{L_{1/2}}(1)z_{L_{1/2}}(1)}. \tag{27}$$

In the next steps some of previously computed values can be again reused for the denominator computation. For the position N−2 the denominator of the criterion (18) is computed using $$\Phi_g(N-2,N-2)=\Phi_g(N-1,N-1)+z_{L_{1/2}}(L_{1/2}+1)z_{L_{1/2}}(L_{1/2}+1). \tag{28}$$

The numerator is computed using Equation (25) with the summation index changed:

$$d_g(N-2) = \sum_{i=0}^{L_{1/2}} x(N-2-L_{1/2}+i)z_{L_{1/2}}(i). \tag{29}$$

In a similar manner, the numerator and the denominator of criterion (18) are calculated for all positions $k'>L_{1/2}$.

The above described procedure allows to find the maximum of the criterion (18) for codevectors that represent the first shape from the glottal impulses. The search will continue using the previously described procedure for all other glottal impulse shapes. The maximum of criterion (18) search continues as glottal-shape codebook search to find one maximum value for criterion (18) that corresponds to the one glottal-shape and one position k' constituting the result of the search.

It is also possible to use sub-sample resolution when searching the glottal pulse center position k'; this will, however, result in increased complexity. More specifically, this will require up-sampling the glottal impulse shapes to increase the resolution and extracting different shifted versions at different resolutions. This is equivalent to using a larger glottal shape codebook.

Ideally the criterion (18) is computed for all possible glottal impulse positions k'. In the non-restrictive illustrative embodiment, the search is performed only in a restrained range around the expected position of the position k' to further reduce the computational complexity. This expected position is in the range $[k_{min}, k_{max}]$, $0 \leqq k_{min} < k_{max} < N$, and can be determined for the first glottal shape from the LP residual signal maximum found as described in the above Section Subframe Selection for Glottal-Shape Codebook Search. A glottal-shape codebook search is then performed and position k' is found for the first glottal shape. The new range $[k_{min}, k_{max}]$ is set for the second glottal shape search as follows:

$$k_{min}=k'-\Delta,$$

$$k_{max}=k'+\Delta. \tag{30}$$

Typically $\Delta=4$. Similarly, Equation (30) is used to define the search range for the third shape around the selected position of the second shape and so on.

In the following example, it is supposed that the initial search range is [N−15, N−7], L=17 and N=64. The search starts with computing the value $z_{L_{1/2}}(n)$. Then the criterion (18) for the position k'=N−7 is evaluated using $$\mathfrak{I}_{N-7} = \frac{(d_g(N-7))^2}{\Phi_g(N-7, N-7)} = \frac{\left(\sum_{i=0}^{L_{1/2}+6} x(N-7-L_{1/2}+i)z_{L_{1/2}}(i)\right)^2}{\sum_{i=0}^{L_{1/2}+7} z_{L_{1/2}}(i)z_{L_{1/2}}(i)} \tag{31}$$

To compute the criterion for position k'=N−8, the denominator is recursively computed as:

$$\Phi_g(N-8,N-8)=\Phi_g(N-7,N-7)+z_{L_{1/2}}(L_{1/2}+8)z_{L_{1/2}}(L_{1/2}+8). \tag{32}$$

In the same manner, the denominator is computed for all remaining positions until k'=N−15. The numerator of criterion (18) is computed for every position within the range [N−15, N−7] separately in a manner similar to Equation (29) using:

$$d_g(k') = \sum_{i=0}^{N-k'+L_{1/2}-1} x(k' - L_{1/2} + i) z_{L_{1/2}}(i). \tag{33}$$

The last parameter to be determined in the glottal-shape codebook search is the gain $g_p$ that can be computed as in Equation (4) with the difference that it is not bounded as in the adaptive codebook search. The reason is that the filtered glottal-shape codevector is constructed using normalized quantized glottal shapes with energy very different from the energy of the actual excitation signal impulses.

The indices related to the glottal impulse position and the glottal shape are transmitted to the decoder. The filtered glottal-shape codevector reconstruction in the decoder is shown in FIG. 11. It should be noted that the pitch period length no longer needs to be transmitted in a glottal-shape codebook search subframe with the exception when the subframe contains more than one glottal impulse as will be discussed hereinafter.

More Glottal Impulses in One Subframe

There are situations where the pitch period of the speech signal is shorter than the subframe length and in this case the subframe can contain more than one glottal impulse (especially in the configuration TRANSITION_1_1). In this case it is necessary to model all the glottal impulses. Given the pitch period length limitations and the subframe length, a subframe cannot contain more than two glottal impulses in this non-restrictive illustrative embodiment.

Figure 12:
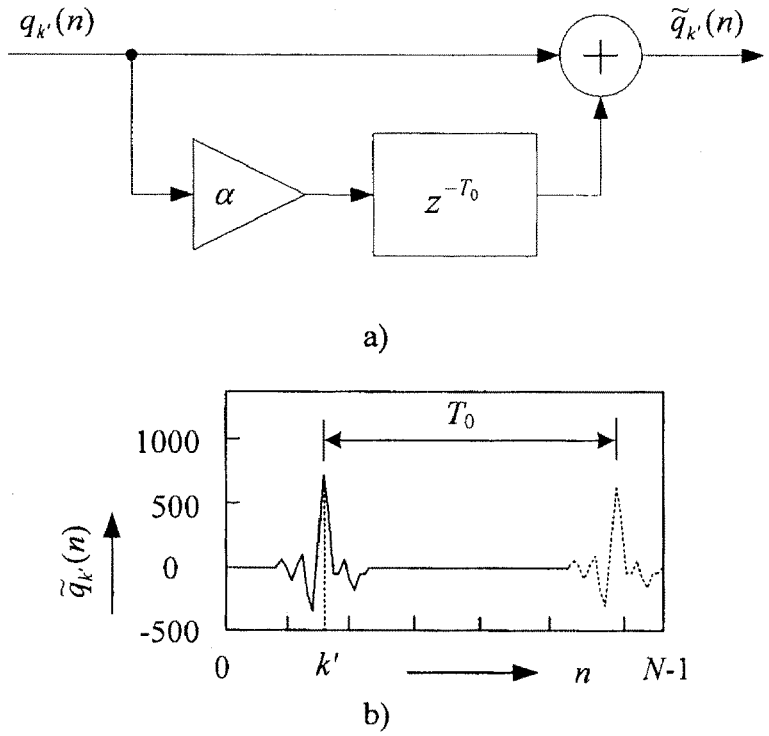
FIG. 12*a* is a schematic block diagram an example of structure of the filter Q(z)
FIG. 12*b* is a graph of an example of glottal-shape codevector modification, wherein the repeated impulse is dotted.

These situations can be solved by two different approaches. The first and simpler one solves these situations by means of a similar procedure as the periodicity enhancement (pitch sharpening) used in AMR-WB (Adaptive Multi-Rate Wideband) as described in Reference [1], where the impulse is basically repeated with the pitch period using a linear filter. As illustrated in FIG. 12*a*, the glottal-shape codevector $q_k(n)$ is thus processed through an adaptive, repetition filter of the form:

$$Q(z) = \frac{1}{1 - \alpha \cdot z^{-T_0}}. \tag{34}$$

The pitch period $T_0$ can be determined for example by the standard closed-loop pitch search approach. The parameter $\alpha$ impacts the energy of the second impulse and, in the non-restrictive illustrative embodiment, has been set to $\alpha$=0.85. This technique adds the missing glottal impulse at the correct position into the glottal-shape codevector. This is illustrated as the dotted impulse in FIG. 12 *b*. This situation appears when the sum of the glottal impulse central position k' and the pitch period $T_0$ is less than the subframe length N, i.e.) $(k'+T_0)<N$. But also in situations where the sum of the impulse position k' and pitch period exceeds the subframe length, the pitch period value is also used to build the fixed codevector when pitch sharpening in the algebraic codebook is used.

Figure 13:
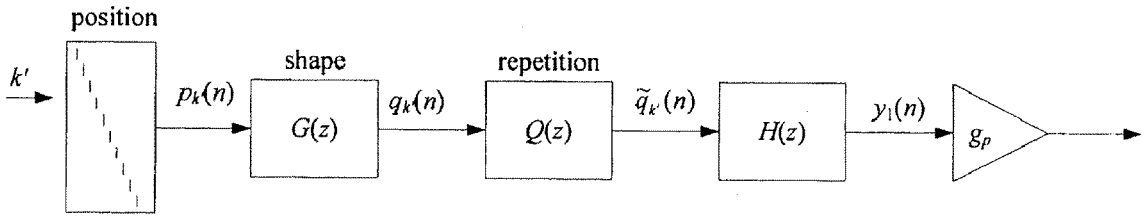
FIG. 13 is a schematic block diagram of the TM portion of a CELP encoder including the filter Q(z)

The repetition filter Q(z) is inserted into the TM part of the codec between the filters G(z) and H(z), as shown in the block diagram of FIG. 13 for the encoder. The same change is made in the decoder. Similarly to pitch sharpening, the impulse response of the repetition filter Q(z) can be added to the impulse response of G(z) and H(z) prior to the codebook search so that both impulses are taken into account during the search while keeping the complexity of the search at a low level.

Figure 14:
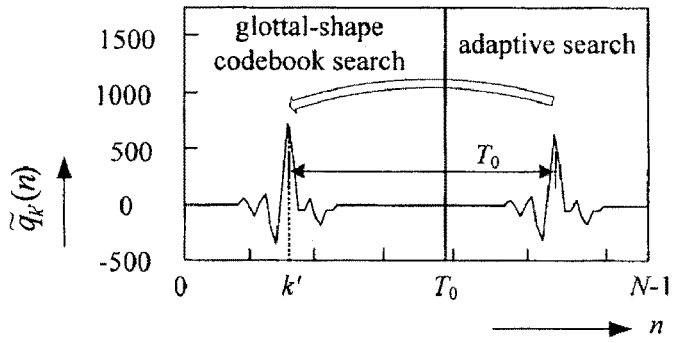
FIG. 14 is a graph illustrating a glottal-shape codevector with two-impulses construction when an adaptive codebook search is used in a part of the subframe with a glottal-shape codebook search.

Another approach to build the glottal-shape codevector with two glottal impulses in one subframe is to use an adaptive codebook search in a part of the subframe. The first $T_0$ samples of the glottal-shape codevector $q_k(n)$ are build using the glottal-shape codebook search and then the other samples in the subframe are build using the adaptive search as shown in FIG. 14. This approach is more complex, but more accurate.

Figure 15:
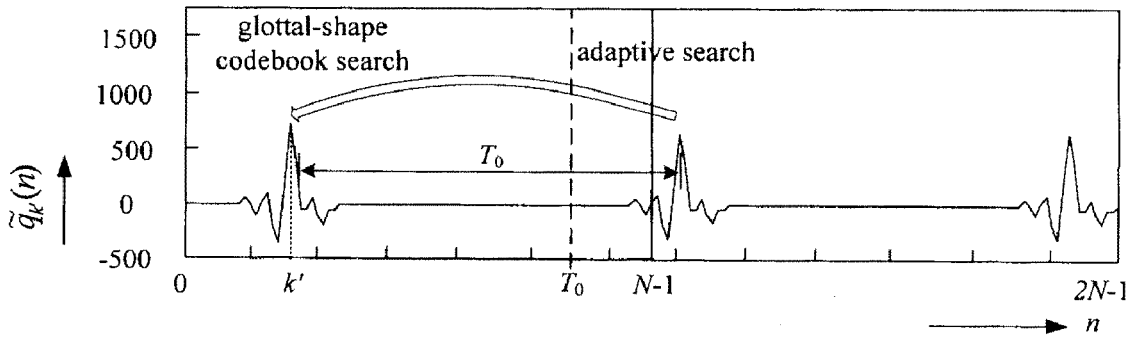
FIG. 15 is a graph illustrating a glottal-shape codevector construction in the case where the second glottal impulse appears in the first $L_{1/2}$ positions of the next subframe.

To further increase the encoding efficiency, the above described procedure can be used even if the second glottal impulse appears in one of the first $L_{1/2}$ positions of the next subframe (FIG. 15). In this situation, i.e. when k' and $T_0$ hold $N \leqq (k'+T_0) < (N+L_{1/2})$, only a few samples (less than $L_{1/2}+1$) of the glottal shape are used at the end of the current subframe. This approach is used in the non-restrictive illustrative embodiment. This approach has a limitation because the pitch period value transmitted in these situations is limited to $T_0<N$ (this is a question of effective encoding), although ideally its value should be limited to $T_0 \leqq N+L_{1/2}$. Therefore if the second glottal impulse appears at the beginning of the next subframe, the repetition procedure cannot be used for some of the first $L_{1/2}$ glottal impulse positions k' of the first glottal impulse.

Implementation of the TM Coding Technique in EV-VBR Codec

Figure 16:
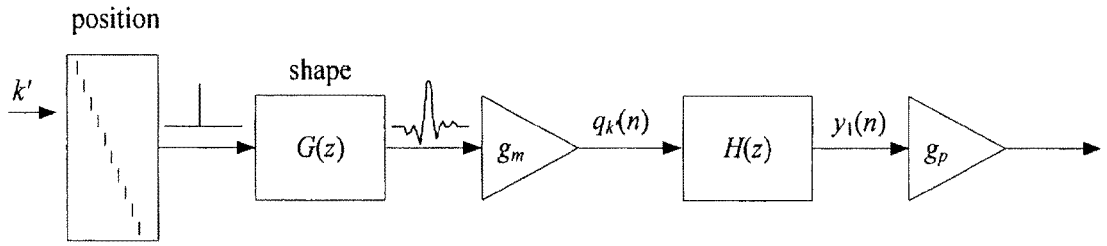
FIG. 16 is a schematic block diagram of the TM portion of an encoder used in a EV-VBR (Embedded Variable Bit Rate) codec implementation.

The TM coding technique according to the non-restrictive illustrative embodiment has been implemented in the EV-VBR codec. EV-VBR uses the internal sampling frequency of 12.8 kHz and the frame length of 20 ms. Each frame is divided into four subframes of N=64 samples. The EV-VBR classification procedure has been adapted to select frames to be encoded using the TM coding technique. In this implementation, the gain of the glottal-shape codebook contribution is quantized in two steps as depicted in FIG. 16, where G(z) is the shaping filter, k' is the position of the centre of the glottal shape and $g_m$ is a TM gain, i.e. a roughly quantized energy of the glottal-shape codevector. The TM gain $g_m$ is found in the same way as the pitch gain using Equation (4) only with the difference that it is not bounded. It is then quantized by means of a 3-bit scalar quantizer and one bit for sign is used. The glottal-shape codevector is then scaled using this gain $g_m$. After both contributions to the filtered excitation signal (first and second stage contribution signals, i.e. the filtered glottal-shape codebook contribution and the filtered algebraic codebook contribution) are found, the gain of the first stage excitation signal is further adjusted jointly with the second stage excitation signal gain quantization, using the standard EV-VBR gain vector quantization (VQ). In this mariner, the gain quantization codebooks of EV-VBR designed for generic or voiced coding modes could be used also in TM coding. Of course, it is within the scope of the present invention to perform the gain quantization using other, different methods.

The search of the glottal impulse central position k' should be theoretically made for all positions in a subframe, i.e. within the range [0, N−1]. Nevertheless as already mentioned, this search is computationally intensive given the number of glottal-shapes to be tried and, in practice, it can be done only in the interval of several samples around the position of the maximum absolute value in the LP residual signal. The searching interval can be set to ±4 samples around the position of the first glottal impulse maximum in the LP residual signal in the current frame. In this manner, processing complexity is approximately the same as for the EV-VBR generic encoding using the adaptive and fixed codebook search.

The transmitted parameters related to the TM coding technique are listed in Table 4 with the corresponding number of bits. The parameter $T_0$, which is used to determine the filter Q(z) or perform adaptive search for the second glottal impulse in case of two impulses in one subframe, is transmitted when $T_0 \leqq N$. The remaining parameters used for a TM frame, but common with the generic ACELP processing, are not shown here (frame identification bits, LP parameters, pitch delay for adaptive excitation, fixed codebook excitation, 1st and 2nd stage codebook gains). When TM parameters are added to the bit stream, the number of bits originally allocated to other EV-VBR parameters is reduced in order to maintain a constant bit rate. These bits can be reduced for example from the fixed codebook excitation bits as well as from the gain quantization.

TABLE 4

Parameters in the bit-stream transmitted for the subframe encoded using the TM.

| Label | Signification | Number of bits |
|---|---|---|
| ID | configuration identification | 1-4 |
| shape | glottal impulse shape | 3 |
| k' | position of the glottal impulse centre | 6 |
| $g_m$ | TM gain | 3 |
| sign($g_m$) | sign of the TM gain | 1 |
| $T_0$ | closed-loop pitch period (if applicable) | 5 |

The bit allocation tables used in EV-VBR are shown herein below. Let us recall that, when the glottal-shape codebook search is not applied to the first subframe, only the fixed codebook and its gain are transmitted to encode the excitation signal in subframes preceding the glottal-shape codebook subframe. The same situation happens for configurations TRANSITION_1_3 and TRANSITION_1_4. In those cases it is possible to maintain the same or even large size of fixed codebook for all subframes as in the original generic ACELP coding.

TM Technique Performance in EV-VBR Codec

Figure 17:
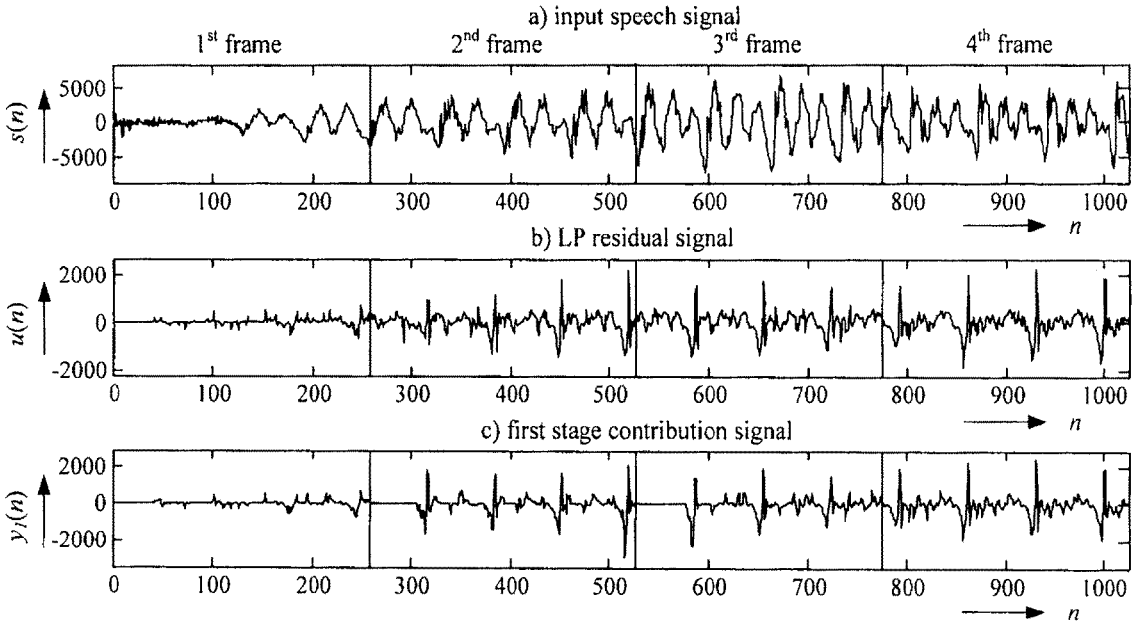
FIG. 17*a* is a graph showing an example of speech signal in the time domain.
FIG. 17*b* is a graph showing a LP residual signal corresponding to the speech signal of FIG. 17*a;*
FIG. 17*c* is a graph showing a first-stage excitation signal in error-free conditions.

In this section some examples of the performance of the TM coding technique in the EV-VBR codec implementation are presented. In FIG. 17 an example of the impact of the TM coding technique is shown for clean-channel condition. FIG. 17*a* shows the input speech signal, FIG. 17*b* shows the LP residual signal and FIG. 17*c* shows the first stage excitation signal where the TM coding technique is used in the first three (3) frames. As expected, the difference between the residual signal and the first stage excitation signal is more pronounced in the beginning of each frame. Towards the end of the frame, the first stage excitation signal corresponds more closely to the residual signal because the standard adaptive codebook search is used.

Tables 5 and 6 summarize some examples of the performance of the TM coding technique measured using SNR values.

In the first example (Table 5) a TM technique was implemented in codec with a core (inner) sampling frequency $F_s$=8 kHz (i.e. a subframe length N=40 samples), glottal-shape codebook with sixteen (16) shapes of length seventeen (17) samples was used, and narrowband input signals were tested. From Table 5 it can be seen that coding voiced onset frames using the TM coding technique enhances the quality of output speech signal (see segmental and weighted segmental SNR values for 1 and 2 TM frames). Further SNR increase can be observed if the voiced onset frame and one following frame are encoded using the TM coding technique. However, if more than one frame following the voiced onset frame is also coded using the TM coding technique, the SNR values decreases. The weighted SNR is the SNR weighted by the frame energy normalized by the frame length, in dB.

TABLE 5

SNR measurements comparison of the impact of the TM coding technique on NB signals.

| Number of TM frames | Weighted segmental | Segmental SNR [dB] | SNR [dB] |
|---|---|---|---|
| 0 (no TM coding) | 10.85 | 10.20 | 12.05 |
| 1 (TM in onset frame) | 10.88 | 10.48 | 11.03 |
| 2 (TM in onset frame + 1 frame) | 10.90 | 10.49 | 11.04 |
| 3 (TM in onset frame + 2 frames) | 10.80 | 10.41 | 10.92 |

Table 6 summarizes an example of the performance of the EV-VBR codec with core (inner) sampling frequency $F_s$=12.8 kHz, WB input speech signal and glottal-shape codebook with eight (8) shapes of length seventeen (17) samples. Mostly because of the longer subframe length N, the SNRs values show some degradation for clean channel when the TM coding technique is used, even if it is used in one frame only. This is caused mostly because of the limited length of the glottal-shape impulses. In comparison to the NB example, more zero values are presented in the first stage excitation signal in the subframe. The benefit of using the TM coding technique in this example is in the FE (Frame Erasure) protection.

TABLE 6

SNR measurements comparison of the impact of the TM coding technique on WB signals.

| Number of TM-coded frames | weighted segmental SNR [dB] | segmental SNR [dB] | SNR [dB] |
|---|---|---|---|
| 0 (no TM coding) | 7.52 | 7.21 | 8.61 |
| 1 (TM in onset frame) | 7.51 | 7.21 | 8.59 |
| 1 (TM in frame after onset frame) | 7.49 | 7.19 | 8.55 |
| 2 (TM in onset frame + 1 frame) | 7.48 | 7.17 | 8.55 |
| 2 (TM in 2 frames after onset frame) | 7.38 | 7.10 | 8.35 |
| 3 (TM in onset frame + 2 frames) | 7.36 | 7.08 | 8.31 |

It should be also noted that even when the TM coding technique is used in a frame after the erased frame, there is still some little difference between the synthesised speech in clean channel and noisy channel. This is because the encoder and the decoder internal states do not depend only on the past excitation signal, but also on many other parameters (e.g. filters memories, ISF (Immitance Spectral Frequencies) quantizer memories, . . . ). It is of course possible to test the variant when a memoryless LP parameters quantization optimized TM coding is used and all the internal states are reset for TM frames. This way all memories that the EV-VBR codec uses in the standard generic encoding mode were reset to ensure that decoder internal states after a frame erasure are the same as its states in error-free conditions. Nevertheless the speech quality in error-free conditions drops significantly for this variant. Consequently, there is a compromise to be made between the high performance in error-free conditions and the robustness to erased frames or packets when no additional memory resets are made.

Table 7 summarizes the computing complexity issue of the TM coding technique. In the worst case the TM coding technique increases the complexity in the encoder by 1.8 WMOPS (Weighted Millions of Operations Per Second). The complexity in the decoder remains approximately the same.

TABLE 7

Complexity of the TM coding technique (worst case and average values).

| | Encoder WMOPS | | Decoder WMOPS | |
|---|---|---|---|---|
| Configuration | Max | Average | Max | Average |
| original (no TM coding) | 36.531 | 34.699 | 7.053 | 5.278 |
| TM coding technique used | 38.346 | 34.743 | 7.055 | 5.281 |

Figure 18:
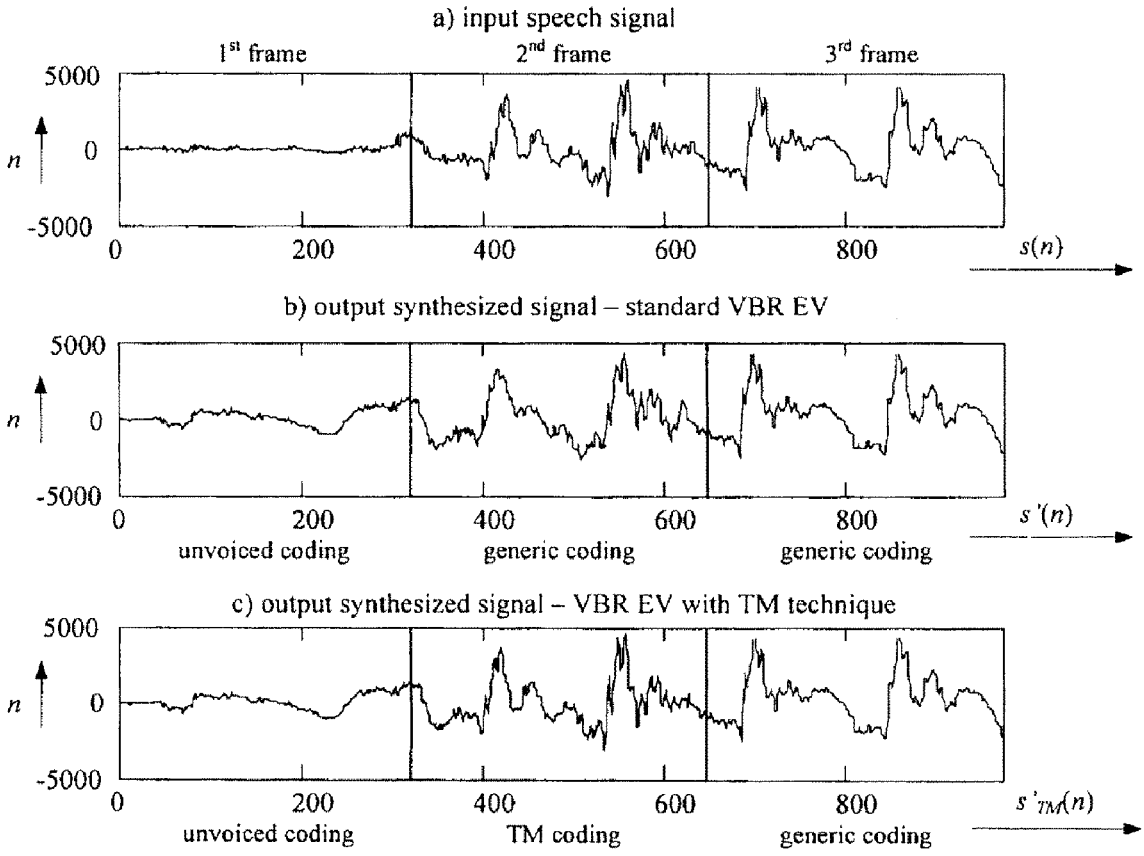
FIGS. 18*a*-18*c* are graphs illustrating an example of onset construction comparison, wherein the graph of FIG. 18*a* represents the input speech signal, the graph of FIG. 18*b* represents the output synthesized speech of a EV-VBR codec without the TM coding technique, and the graph of FIG. 18*c* represents the output synthesized speech of a EV-VBR codec with the TM coding technique.
Figure 19:
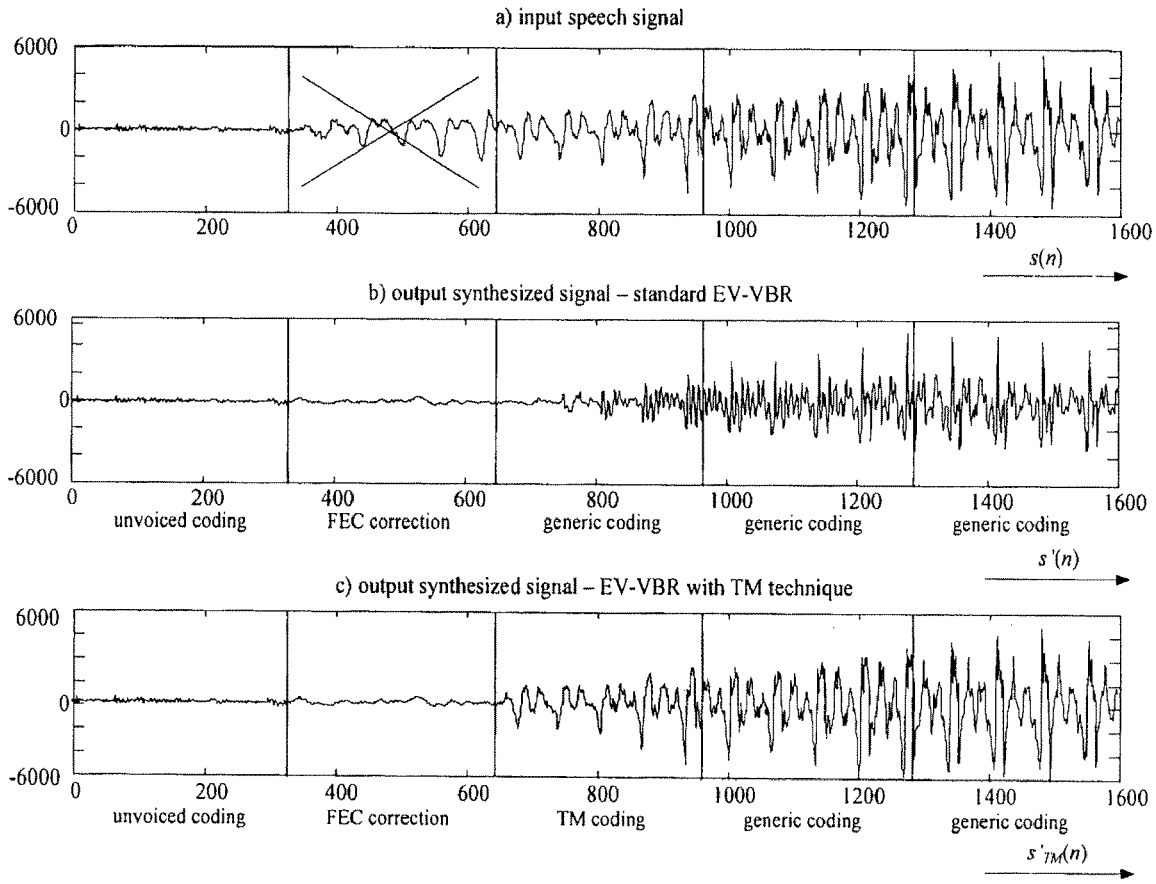
FIG. 19*a*-19*c* are graphs illustrating an example of the effect of the TM coding technique in the case of frame erasure, wherein the graph of FIG. 19*a* represents the input speech signal, the graph of FIG. 19*b* represents the output synthesized speech of a EV-VBR codec without the TM coding technique, and the graph of FIG. 19*c* represents the output synthesized speech of a EV-VBR codec with the TM coding technique.

The following figures illustrate the performance of the TM coding technique for voiced onset frame modeling (FIGS. 18*a*-18*c*) and for frame error propagation mitigation (FIGS. 19*a*-19*c*). The TM coding technique is used only in one frame at a time in this example. A segment of the input speech signal (FIGS. 18*a* and 19*a*), the corresponding output synthesized speech signal processed by the EV-VBR decoder without the TM coding technique as illustrated in FIGS. 18*b* and 19*b*, and the output synthesized speech signal processed using the standard EV-VBR decoder with TM coding technique (FIGS. 18*c* and 19*c*) are shown. The benefits of the TM coding technique can be observed both in the modeling of the voiced onset frame (2nd frame of FIG. 18) and in the limitation of frame error propagation (4th and 5th frames of FIG. 19).

The frame erasure concealment technique used in the EV-VBR decoder is based on the use of an extra decoder delay of 20 ms length (corresponding to one frame length). It means that if a frame is missing, it is concealed with the knowledge of the future frame parameters. Let us suppose three (3) consecutive frames that are denoted as m−1, m and m+1 and further suppose a situation when the frame m is missing. Then an interpolation of the last correctly received frame m−1 and the following correctly received frame m+1 can be computed in view of determining the codec parameters, including in particular but not exclusively the LP filter coefficients (represented by ISFs—Immitance Spectral Frequencies), closed-loop pitch period $T_0$, pitch and fixed codebook gains. The interpolation helps to estimate the lost frame parameters more accurately for stable voiced segments. However, it often fails for transition segments when the codec parameters vary rapidly. To cope with this problem, the absolute value of the pitch period can be transmitted in every TM frame even in the case that it is not used for the first stage excitation construction in the current frame m+1. This is valid especially for configurations TRANSITION_1_4 and TRANSITION_4.

Other parameters transmitted in a TM frame are the ISFs of the preceding frame. In CELP-type encoders, the ISF parameters are generally interpolated between the previous frames ISFs and the current frame ISFs for each subframe. This ensures a smooth evolution of the LP synthesis filter from one subframe to another. In case of a frame erasure, the ISFs of the frame preceding the frame erasure are usually used for the interpolation in the frame following the erasure, instead of the erased frame ISFs. However during transition segments, the ISFs vary rapidly and the last-good frame ISFs might be very different from the ISFs of the missing, erased frame. Replacing the missing frame ISFs by the ISFs of the previous frame may thus cause important artefacts. If the past frame ISFs can be transmitted, they can be used for ISF interpolation in the TM frame in case the previous frame is erased. Later, different estimations of LP coefficients used for the ISF interpolation when the frame preceding a TM frame is missing will be described.

The final implementation of the TM coding technique to the EV-VBR codec supposes that only one frame after onset/transition frame is coded using TM. In this manner, about 6.3% of active speech frames are selected for TM encoding and decoding.

Another category of tests focused on the increase in encoding efficiency. The classification was made in the closed-loop search when two variants—with and without the TM coding technique—were computed side by side in the encoder and a variant with a higher SNR was chosen as an output signal.

Results for the EV-VBR codec with bit rate of 8 kbps are summarized in Table 8. In the WB case, 28% of active speech frames was classified for encoding using the TM coding technique and an increase of 0.203 dB in segmental SNR was achieved. In the NB case, 25% of active speech frames was classified for encoding using the TM coding technique and an increase of even 0.300 dB in segmental SNR was achieved. Unfortunately this objective test increase was not confirmed by subjective listening tests that reported no preference between codec with and without the TM coding technique. Although there is no speech quality degradation and the total number of TM frames is four (4) times higher compared with an open-loop classification that results in much higher FE protection, this classification and similar result classifications are better not used in an EV-VBR codec implementation due to the increased complexity.

TABLE 8

Segmental SNR and SNR measure comparison between codec with and without TM coding technique implemented when close-loop classification is used.

| Number of TM-coded frames | segmental SNR [dB] | SNR [dB] |
|---|---|---|
| Codec without TM, WB signal | 7.34 | 8.89 |
| Codec with TM, WB signal | 7.54 | 9.04 |
| Codec without TM, NB signal | 7.58 | 10.62 |
| Codec with TM, NB signal | 7.88 | 10.97 |

Bit-Allocation Tables for TM Coding Technique in EV-VBR Codec

The TM coding technique was implemented in an EV-VBR codec candidate for ITU-T standardization. The following Table 9 shows bit allocation tables of the original generic mode and all TM coding mode configurations that were introduced herein above. These configurations are used in the EV-VBR codec.

TABLE 9

Bit allocation tables for generic coding mode and for all TM configurations as used in the EV-VBR codec (ID stands for configuration identification, ISFs for Immitance Spectral Frequencies and FCB for Fixed CodeBook, subfr. is subframe).

| a) GENERIC | | b) TRANSITION_1_1 | | c) TRANSITION_1_2 | |
|---|---|---|---|---|---|
| # bits | parameter | # bits | parameter | # bits | parameter |
| 2 | coder type | 2 | coder type | 2 | coder type |
| 1 | NB/WB | 1 | NB/WB | 1 | NB/WB |
| 36 | ISFs | 36 | ISFs | 36 | ISFs |
| 3 | energy estimate | 3 | energy estimate | 3 | energy estimate |
| 8 | $1^{st}$ subfr. pitch | 1 | TM subfr. ID | 1 | TM subfr. ID |
| 5 | $1^{st}$ subfr. gains | 5 | $1^{st}$ subfr. pitch | 1 | TM subfr. ID |
| 5 | $2^{nd}$ subfr. pitch | 3 | TM shape | 3 | TM shape |
| 5 | $2^{nd}$ subfr. gains | 6 | TM position | 6 | TM position |
| 8 | $3^{rd}$ subfr. pitch | 1 | TM gain sign | 1 | TM gain sign |
| 5 | $3^{rd}$ subfr. gains | 3 | TM gain value | 3 | TM gain value |
| 5 | $4^{th}$ subfr. pitch | 5 | $1^{st}$ subfr. gains | 5 | $1^{st}$ subfr. gains |
| 5 | $4^{th}$ subfr. gains | 5 | $2^{nd}$ subfr. pitch | 1 | TM subfr. ID2 |
| 12 | $1^{st}$ subfr. FCB | 5 | $2^{nd}$ subfr. gains | 1 | TM subfr. ID2 |
| 20 | $2^{nd}$ subfr. FCB | 5 | $3^{rd}$ subfr. pitch | 7 | $2^{nd}$ subfr. pitch |
| 20 | $3^{rd}$ subfr. FCB | 5 | $3^{rd}$ subfr. gains | 5 | $2^{nd}$ subfr. gains |
| 20 | $4^{th}$ subfr. FCB | 5 | $4^{th}$ subfr. pitch | 5 | $3^{rd}$ subfr. pitch |
| 160 bits | total | 5 | $4^{th}$ subfr. gains | 5 | $3^{rd}$ subfr. gains |
| | | 20 | $1^{st}$ subfr. FCB | 5 | $4^{th}$ subfr. pitch |
| | | 20 | $2^{nd}$ subfr. FCB | 5 | $4^{th}$ subfr. gains |
| | | 12 | $3^{rd}$ subfr. FCB | 20 | $1^{st}$ subfr. FCB |
| | | 12 | $4^{th}$ subfr. FCB | 20 | $2^{nd}$ subfr. FCB |
| | | 160 bits | total | 12 | $3^{rd}$ subfr. FCB |
| | | | | 12 | $4^{th}$ subfr. FCB |
| | | | | 160 bits | total |

| d) TRANSITION_1_3 | | e) TRANSITION_1_4 | | f) TRANSITION_2 | |
|---|---|---|---|---|---|
| # bits | parameter | # bits | parameter | # bits | parameter |
| 2 | coder type | 2 | coder type | 2 | coder type |
| 1 | NB/WB | 1 | NB/WB | 1 | NB/WB |
| 36 | ISFs | 36 | ISFs | 36 | ISFs |
| 3 | energy estimate | 3 | energy estimate | 3 | energy estimate |
| 1 | TM subfr. ID | 1 | TM subfr. ID | 1 | TM subfr. ID |
| 1 | TM subfr. ID | 1 | TM subfr. ID | 1 | TM subfr. ID |
| 3 | TM shape | 3 | TM shape | 1 | TM subfr. ID |
| 6 | TM position | 6 | TM position | 2 | $1^{st}$ subfr. gain |
| 1 | TM gain sign | 1 | TM gain sign | 3 | TM shape |
| 3 | TM gain value | 3 | TM gain value | 6 | TM position |
| 5 | $1^{st}$ subfr. gains | 5 | $1^{st}$ subfr. gains | 1 | TM gain sign |
| 1 | TM subfr. ID2 | 1 | TM subfr. ID2 | 3 | TM gain value |
| 1 | TM subfr. ID2 | 3 | $2^{nd}$ subfr. gain | 5 | $2^{nd}$ subfr. gains |
| 3 | $2^{nd}$ subfr. gain | 2 | $3^{rd}$ subfr. gain | 8 | $3^{rd}$ subfr. pitch |
| 7 | $3^{rd}$ subfr. pitch | 7 | $4^{th}$ subfr. pitch | 5 | $3^{rd}$ subfr. gains |
| 5 | $3^{rd}$ subfr. gains | 5 | $4^{th}$ subfr. gains | 5 | $4^{th}$ subfr. pitch |
| 4 | $4^{th}$ subfr. pitch | 20 | $1^{st}$ subfr. FCB | 5 | $4^{th}$ subfr. gains |
| 5 | $4^{th}$ subfr. gains | 20 | $2^{nd}$ subfr. FCB | 20 | $1^{st}$ subfr. FCB |
| 20 | $1^{st}$ subfr. FCB | 20 | $3^{rd}$ subfr. FCB | 20 | $2^{nd}$ subfr. FCB |
| 12 | $2^{nd}$ subfr. FCB | 20 | $4^{th}$ subfr. FCB | 12 | $3^{rd}$ subfr. FCB |
| 20 | $3^{rd}$ subfr. FCB | 160 bits | total | 20 | $4^{th}$ subfr. FCB |
| 20 | $4^{th}$ subfr. FCB | | | 160 bits | total |
| 160 bits | total | | | | |

| g) TRANSITION_3 | | h) TRANSITION_4 | |
|---|---|---|---|
| # bits | parameter | # bits | parameter |
| 2 | coder type | 2 | coder type |
| 1 | NB/WB | 1 | NB/WB |
| 36 | ISFs | 36 | ISFs |
| 3 | energy estimate | 3 | energy estimate |
| 1 | TM subfr. ID | 1 | TM subfr. ID |
| 1 | TM subfr. ID | 1 | TM subfr. ID |
| 1 | TM subfr. ID | 1 | TM subfr. ID |

TABLE 9-continued

Bit allocation tables for generic coding mode and for all TM configurations as used in the EV-VBR codec (ID stands for configuration identification, ISFs for Immitance Spectral Frequencies and FCB for Fixed CodeBook, subfr. is subframe).

| | | | |
|---|---|---|---|
| 1 | TM subfr. ID | 1 | TM subfr. ID |
| 3 | $1^{st}$ subfr. gain | 3 | $1^{st}$ subfr. gain |
| 3 | $2^{nd}$ subfr. gain | 2 | $2^{nd}$ subfr. gain |
| 5 | $3^{rd}$ subfr. pitch | 3 | $3^{rd}$ subfr. gain |
| 3 | TM shape | 8 | $4^{th}$ subfr. pitch |
| 6 | TM position | 3 | TM shape |
| 1 | TM gain sign | 6 | TM position |
| 3 | TM gain value | 1 | TM gain sign |
| 5 | $3^{rd}$ subfr. gains | 3 | TM gain value |
| 8 | $4^{th}$ subfr. pitch | 5 | $4^{th}$ subfr. gains |
| 5 | $4^{th}$ subfr. gains | 20 | $1^{st}$ subfr. FCB |
| 12 | $1^{st}$ subfr. FCB | 20 | $2^{nd}$ subfr. FCB |
| 20 | $2^{nd}$ subfr. FCB | 20 | $3^{rd}$ subfr. FCB |
| 20 | $3^{rd}$ subfr. FCB | 20 | $4^{th}$ subfr. FCB |
| 20 | $4^{th}$ subfr. FCB | 160 bits | total |
| 160 bits | total | | |

There is one exception to the configuration TRANSITION_2 in Table 9. This bit-allocation table can be used only in the situation when it is decided to use the TM coding technique in the frames following the voiced onset frame only (the voiced onset frame is encoded using the generic coding mode and only one frame following the voiced onset frame is encoded using the TM coding technique). In this situation, the pitch period $T_0$ is $T_0 \geqq N$ in the second subframe and there is no need to transmit this parameter in the $2^{nd}$ subframe. But if the TM coding technique is used also in the voiced onset frame, the following situation may occur. The pitch period is shorter than N, but the voiced onset can start only in the $2^{nd}$ subframe (e.g. the first subframe still containing unvoiced signal). In this case the pitch period $T_0$ must be transmitted. In this situation a different bit-allocation table is used, parameter $T_0$ is transmitted in the $2^{nd}$ subframe using five (5) bits and in one subframe a shorter fixed codebook is used (see Table 10). The same situation appears also for the configuration TRANSITION_3. However, the pitch period is transmitted here anyway in the present, non-limitative implementation (whether the onset frame is coded using the TM coding technique or not) because there is no good use of the saved bits for another parameter encoding.

Other bit allocations can be used in different transition mode configurations. For instance, more bits can be allocated to the fixed codebooks in the subframes containing glottal pulses. For example, in TRANSITION_3 mode, a FCB with twelve (12) bits can be used in the second subframe and twenty-eight (28) bits in the third subframe. Of course, other than 12- and 20-bit FCBs can be used in different coder implementations.

TABLE 10

Bit allocation table for configuration TRANSITION_2 if TM is used also in the onset frame. TRANSITION_2a

| # bits | parameter |
|---|---|
| 2 | coder type |
| 1 | NB/WB |
| 36 | ISFs |
| 3 | Energy estimate |
| 1 | TM subfr. ID |
| 1 | TM subfr. ID |
| 1 | TM subfr. ID |

TABLE 10-continued

Bit allocation table for configuration TRANSITION_2 if TM is used also in the onset frame. TRANSITION_2a

| # bits | parameter |
|---|---|
| 3 | $1^{st}$ subfr. Gain |
| 5 | $2^{nd}$ subfr pitch |
| 3 | TM shape |
| 6 | TM position |
| 1 | TM gain sign |
| 3 | TM gain value |
| 5 | $2^{nd}$ subfr. Gains |
| 8 | $3^{rd}$ subfr. Pitch |
| 5 | $3^{rd}$ subfr. gains |
| 5 | $4^{th}$ subfr. Pitch |
| 5 | $4^{th}$ subfr. Gains |
| 20 | $1^{st}$ subfr. FCB |
| 20 | $2^{nd}$ subfr. FCB |
| 12 | $3^{rd}$ subfr. FCB |
| 12 | $4^{th}$ subfr. FCB |
| 158 | bits total |

If there is available bandwidth, further enhancement can be achieved by transmitting more information for better frame erasure (FE) protection. The VMR-WB codec is an example of a codec that uses some portion of FE protection bits. For example fourteen (14) protection bits per frame are used in the Generic Full-Rate encoding type in VMR-WB in Rate-Set II. These bits represent frame classification (2 bits), synthesized speech energy (6 bits) and glottal pulse position (6 bits). The glottal pulse is inserted artificially in the decoder when a voiced onset frame is lost. These FER protection bits are not much important for excitation construction in a TM frame because the TM coding technique does not make use of the past excitation signal; the TM coding technique constructs the excitation signal using parameters transmitted in the current (TM) frame. These bits can be however employed for the transmission of other parameters. In an example of implementation, these bits can be used to transmit in the current TM frame the ISF parameters of the previous frame; however twelve (12) bits instead of thirty-six (36) bits are available). These ISFs are used for more precise LP filter coefficients reconstruction in case of frame erasure.

In the EV-VBR codec the set of LP parameters is computed centered on the fourth subframe, whereas the first, second, and third subframes use a linear interpolation of the LP filter parameters between the current and the previous frame. The interpolation is performed on the ISPs (Immitance Spectral Pairs). Let $q_4^{(m)}$ be the ISP vector at the $4^{th}$ subframe of the frame, and $q_4^{(m-1)}$ the ISP vector at the $4^{th}$ subframe of the past frame m−1. The interpolated ISP vectors at the $1^{st}$, $2^{nd}$, and $3^{rd}$ subframes are given by the Equations:

$$q_1^{(m)}=0.55q_4^{(m-1)}+0.45q_4^{(m)},$$

$$q_2^{(m)}=0.2q_4^{(m-1)}+0.8q_4^{(m)},$$

$$q_3^{(m)}=0.04q_4^{(m-1)}+0.96q_4^{(m)}. \quad (35)$$

This interpolation is however not directly suited for the TM coding technique in the case of erasure of the previous frame. When the frame preceding the TM frame is missing, it can be supposed that the last correctly received frame is unvoiced. It is more efficient in this situation to reconstruct the ISF vector for the missing frame with different interpolation constants and it does not matter if we have some ISFs information from FER protection bits available or not. In general, the interpolation is using the previous frame ISPs more heavily. The ISP vectors for the missing frame m can be given at the decoder, for example by using the following Equations:

$$q_1^{(m)}=q_4^{(m-1)},$$

$$q_2^{(m)}=q_4^{(m-1)},$$

$$q_3^{(m)}=0.7q_4^{(m-1)}+0.3q_4^{(m)},$$

$$q_4^{(m)}=0.1q_4^{(m-1)}+0.9q_4^{(m)}. \quad (36)$$

The following correctly received TM frame m+1 then uses LP coefficients interpolation described by the Equations (35). Also the interpolation coefficients in Equations (36) are given as a non-limitative example. The final coefficients could be different and additionally it is desirable to use one set of interpolation coefficients when some ISF information from the previous frame is available and another set when ISF information from the previous frame is not available (i.e. there are no frame erasure protection bits in the bit stream).

Pitch Period and Gain Encoding in TM Frames in EV-VBR Codec

The value of the pitch period $T_0$ is transmitted for every subframe in the generic encoding mode used in the EV-VBR codec. In the $1^{st}$ and $3^{rd}$ subframes, an 8-bit encoding is used while the pitch period value is transferred with fractional (½ for $T_0$ in the range [$T_{min}$, 91½]) or integer (for $T_0$ in the range [92, $T_{max}$]) resolution. In the $2^{nd}$ and $4^{th}$ subframes, a delta search is used and the pitch period value always with fractional resolution is coded with five (5) bits. Delta search means a search within the range [$T_{0p}$−8, $T_{0p}$+7½], where $T_{0p}$ is the nearest integer to the fractional pitch period of the previous ($1^{st}$ or $3^{rd}$) subframe. The values of the pitch period are limited in the EV-VBR codec to values within the range [$T_{min}$, $T_{max}$], where $T_{min}$=34 and $T_{max}$=231.

The pitch gain $g_p$ and the fixed codebook gain $g_c$ are encoded in the EV-VBR codec in principle in the same manner as in the AMR-WB+codec [5]. First an estimation of a non-predictive scaled fixed codebook energy is calculated for all subframes in a frame and quantized with three (3) bits once per frame (see the parameter energy estimate in Table 9). Then the pitch gain $g_p$ and the fixed codebook gain $g_c$ are vector quantized and coded in one step using five (5) bits for every subframe.

The estimated fixed codebook energy is computed and quantized as follows. First, the LP residual energy is computed in each subframe k using the following Equation:

$$E_{res}(k) = 10\log_{10}\left(\frac{1}{N}\sum_{n=0}^{N_1} u^2(n)\right), \quad (37)$$

where u(n) is the LP residual signal. Then the average residual energy per subframe is found through the following Equation:

$$\overline{E}_{res} = \frac{1}{4}\sum_{k=0}^{3} E_{res}(k). \quad (38)$$

The fixed codebook energy is estimated from the residual energy by removing an estimate of the adaptive codebook contribution. This is done by removing an energy related to the average normalized correlation obtained from the two open-loop pitch analyses performed in the frame. The following Equation is used:

$$E_s=\overline{E}_{res}-10\overline{R}, \quad (39)$$

where $\overline{R}$ is the average of the normalized pitch correlations obtained from the open-loop pitch analysis for each half-frame of the current frame. The estimated scaled fixed codebook energy is not dependant on the previous frame energy and thus the gain encoding principle is robust to frame erasures.

Once the estimation of the fixed codebook energy is found, the pitch gain and the fixed codebook gain correction are computed: the estimated scaled fixed codebook energy is used to calculate the estimated fixed codebook gain and the correction factor γ (ratio between the true and the estimated fixed codebook gains). The value γ is vector quantized together with the pitch gain using five (5) bits per subframe. For the design of the quantizer, a modified k-means method [4] is used. The pitch gain is restricted within the interval <0; 1.2> during the codebook initialization and <0; ∞> during the iterative codebook improvement. Likewise, the correction factor γ is limited by <0; 5> during initialization and <0; ∞> during the codebook improvement. The modified k-means algorithm seeks to minimize the following criterion:

$$E=g_p^2y_1^Ty_1-2g_px_1^Ty_1+g_c^2y_2^Ty_2-2g_cx_1^Ty_2+2g_pg_cy_1^Ty_2. \quad (40)$$

When using the TM coding technique, transmission of the pitch period and both pitch and fixed codebook gains may not be required for subframes where there is no important glottal impulse, and only the fixed codebook contribution may be computed.

Figure 20:
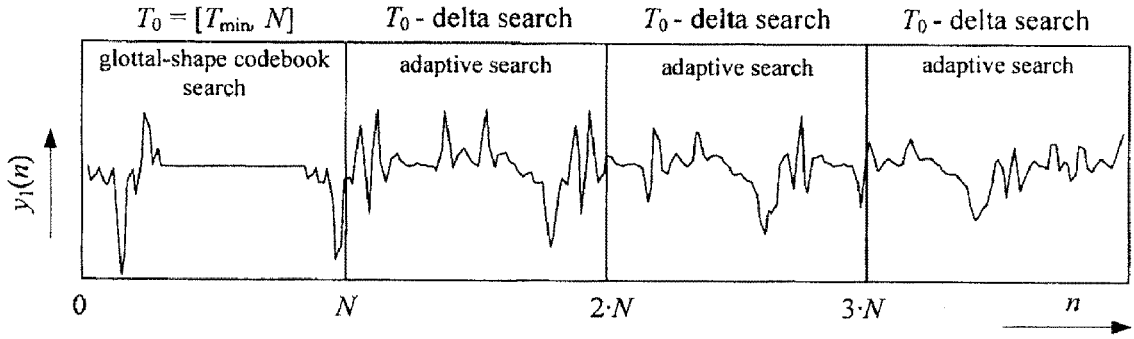
FIG. 20 is a graph illustrating an example of the first-stage excitation signal in one frame of the configuration TRANSITION_1_1.

The following is a list and description of all TM configurations:

Configuration TRANSITION_1_1 (FIG. 20)—In this configuration one or two first glottal impulses appear in the first subframe that is processed using the glottal-shape codebook search. This means that the pitch period value in the first subframe can have a maximum value less than the subframe length, i.e. $T_{min}<T_0<N$. With the integer resolution it can be coded with five (5) bits. The pitch periods in the next subframes are found using 5-bits delta search with a fractional resolution.

This is the most bit-demanding configuration of the TM coding technique, i.e. when the glottal-shape codebook is used in the first subframe and the pitch period $T_0$ is transmitted for Q(z) filter determination, or for the adaptive codebook search in the part of the first subframe. This configuration uses in the first subframe the procedure as described above. This configuration is used in the EV-VBR codec also when only one glottal impulse appears in the first subframe. Here the pitch period $T_0$ holds $T_0<N$ and it is used for periodicity enhancement [1] in fixed codebook search.

Figure 21:
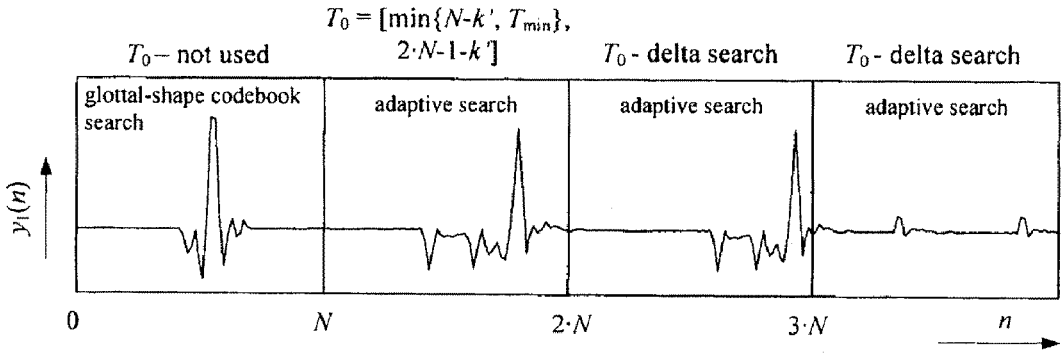
FIG. 21 is a graph illustrating an example of the first-stage excitation signal in one frame of the configuration TRANSITION_1_2.

Configuration TRANSITION_1_2 (FIG. 21)—When the configuration TRANSITION_1_2 is used, the first subframe is processed using the glottal-shape codebook search. The pitch period is not needed and all following subframes are processed using the adaptive codebook search. Because the second subframe is known to contain the second glottal impulse, the pitch period maximum value holds $T_0 \leqq 2 \cdot N-1$. This maximum value can be further reduced thanks to knowledge of the glottal impulse position k'. The pitch period value in the second subframe is then coded using seven (7) bits with a fractional resolution in the whole range. In the third and fourth subframes, delta search using five (5) bits is used with a fractional resolution.

Figure 22:
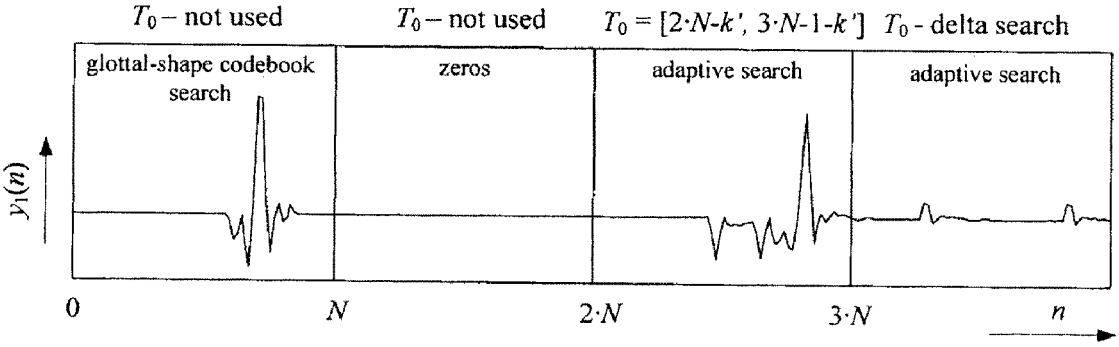
FIG. 22 is a graph illustrating an example of the first-stage excitation signal in one frame of the configuration TRANSITION_1_3.

Configuration TRANSITION_1_3 (FIG. 22)—When the configuration TRANSITION_1_3 is used the first subframe is processed using the glottal-shape codebook search again with no use of the pitch period. Because the second subframe of the LP residual signal contains no glottal impulse and the adaptive search is useless, the first stage excitation signal is replaced by zeros in the second subframe. The adaptive codebook parameters ($T_0$ and $g_p$) are not transmitted in the second subframe and saved bits are used for the FCB size increase in the third subframe. Because the second subframe contains a minimum of the useful information, only the 12-bits FCB is used and the 20-bits FCB is used in the fourth subframe. The first stage excitation signal in the third subframe is constructed using the adaptive codebook search with the pitch period maximum value ($3 \cdot N-1-k'$) and minimum value ($2 \cdot N-k'$); thus only a 7-bits encoding of the pitch period with fractional resolution over all the range is used. The fourth subframe is processed using the adaptive search again with a 5-bits delta search encoding of the pitch period value.

In the second subframe only the fixed codebook gain $g_c$ is transmitted. Consequently, only two (2) or three (3) bits are needed for gain quantization instead of the 5-bits quantizer used in the subframe with traditional ACELP encoding (i.e. when gains $g_p$ and $g_c$ are transmitted). This is valid also for all the following configurations. The decision as to whether the gain quantizer should use two (2) or three (3) bits is made to fit the number of bits available in the frame.

Figure 23:
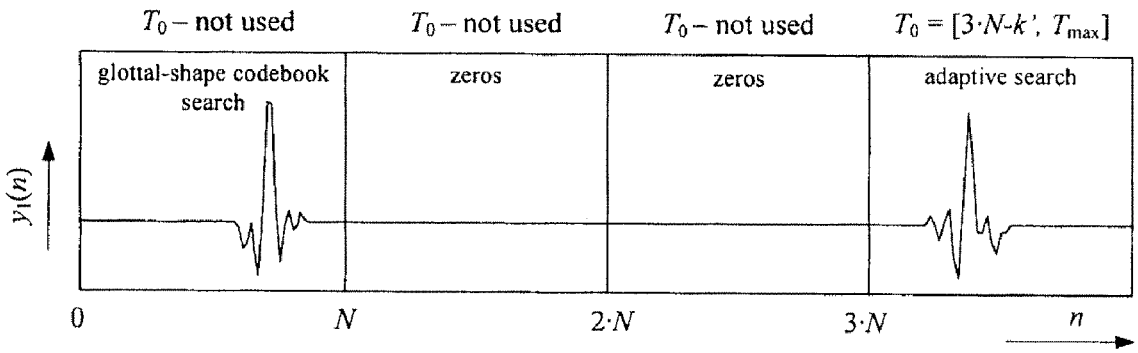
FIG. 23 is a graph illustrating an example of the first-stage excitation signal in one frame of the configuration TRANSITION_1_4.

Configuration TRANSITION_1_4 (FIG. 23)—When the configuration TRANSITION_1_4 is used, the first subframe is processed using the glottal-shape codebook search. Again, the pitch period does not need to be transmitted. But because the LP residual signal contains no glottal impulse in the second and also in the third subframe, the adaptive codebook search is useless for these two subframes. Again, the first stage excitation signal in these subframes is replaced by zeros and saved bits are used for the FCB size increase so that all subframes can benefit and use the 20-bits FCBs. The pitch period value is transmitted only in the fourth subframe and its minimum value is ($3 \cdot N-k'$). The maximum value of the pitch period is limited by $T_{max}$. It does not matter if the second glottal impulse appears in the fourth subframe or not (the second glottal impulse can be present in the next frame if $k'+T_{max} \geqq N$).

The absolute value of the pitch period is used at the decoder for the frame concealment; therefore this absolute value of the pitch period is transmitted in the situation when the second glottal impulse appears in the next frame. When a frame m preceding the TM frame m+1 is missing, the correct knowledge of the pitch period value from the frames m−1 and m+1 helps to reconstruct the missing part of the synthesis signal in the frame m successfully.

Configuration TRANSITION_2 (FIG. 24)—When the first glottal impulse appears in the second subframe and only frames after voiced onset frames are encoded using the TM coding technique (i.e. the voiced onset frames are encoded with the legacy generic encoding), the pitch period is transmitted only in the third and fourth subframes. In this case, only fixed codebook parameters are transmitted in the first subframe.

Figure 24:
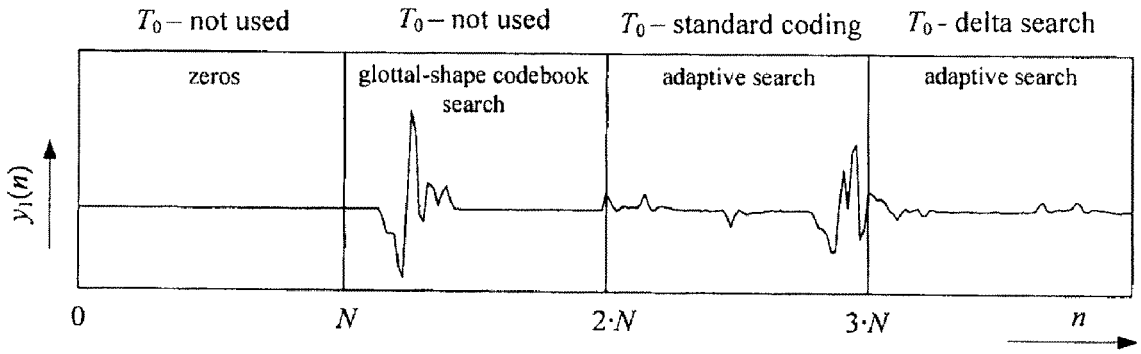
FIG. 24 is a graph illustrating an example of the first-stage excitation signal in one frame of the configuration TRANSITION_2.

The frame shown in FIG. 24 supposes the configuration when TM is not used in voiced onset frames. If TM is used also in the voiced onset frames, the configuration TRANSITION_2*a* is used where the pitch period $T_0$ is transmitted in the second subframe for using the procedure as described above.

Figure 25:
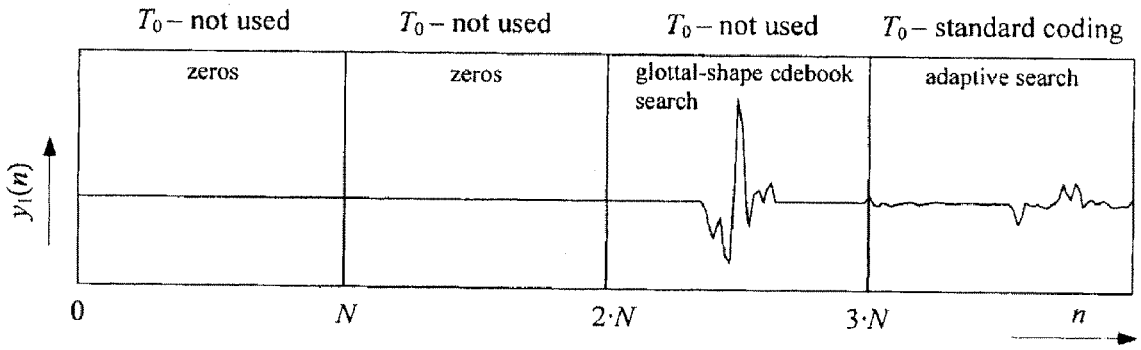
FIG. 25 is a graph illustrating an example of the first-stage excitation signal in one frame of the configuration TRANSITION_3.

Configuration TRANSITION_3 (FIG. 25)—When the first glottal impulse appears in the third subframe and only frames after the voiced onset frames are encoded using the TM coding technique (i.e. the voiced onset frames are coded with the legacy generic encoding), the pitch period is transmitted only in the fourth subframe. In this case only fixed codebook parameters are transmitted in the first and second subframes.

The pitch period is still transmitted for the third subframe in the bit stream. However it is not useful if the TM coding technique is not used to encode the voiced onset frames. This value is useful only when voiced onset frames are encoded using the TM coding technique.

Figure 26:
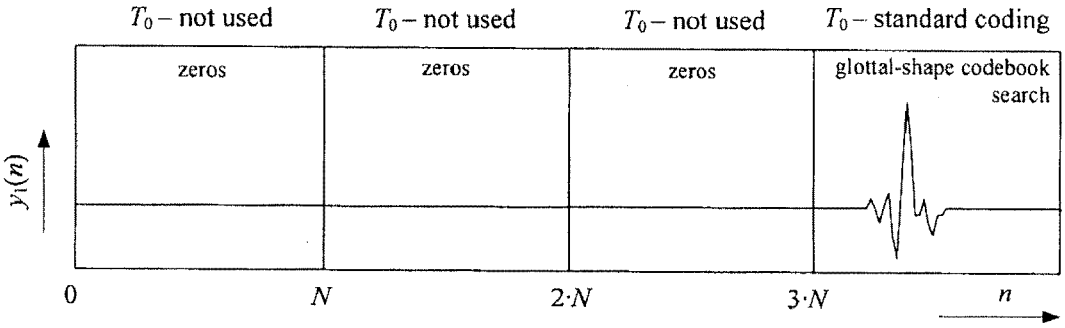
FIG. 26 is a graph illustrating an example of the first-stage excitation signal in one frame of the configuration TRANSITION_4.

Configuration TRANSITION_4 (FIG. 26)—When the first glottal impulse appears in the fourth subframe and only frames after voiced onset frames are encoded using the TM coding technique (i.e. the voiced onset frames are encoded with the legacy generic encoding), the pitch period value information is not used in this subframe. However the pitch period value is used in the frame concealment at the decoder (this value is used for the missing frame reconstruction when the frame preceding the TM frame is missing). Thus the pitch value is transmitted only in the fourth subframe and only fixed codebook parameters are transmitted in the first, second and third subframes (the gain pitch $g_p$ is not required). The saved bits allow for the 20-bits FCB to be used in every subframe.

Although the present invention has been described in the foregoing description in connection with a non-restrictive illustrative embodiment thereof, this non-restrictive illustrative embodiment can be modified at will, within the scope of the appended claims, without departing from the scope and spirit of the present invention.

References

[1] B. BESSETTE, R. SALAMI, R. LEFEBVRE, M. JELINEK, J. ROTOLA-PUKKILA, J. VAINIO, H. MIKKOLA, and K. JARVINEN, "The Adaptive Multi-Rate Wideband Speech Codec (AMR-WB)", Special Issue of IEEE Transactions on Speech and Audio Processing, Vol. 10, No. 8, pp. 620-636, November 2002.

[2] R. SALAMI, C. LAFLAMME, J-P. ADOUL, and D. MASSALOUX, "A toll quality 8 kb/s speech codec for the personal communications system (PCS)", IEEE Trans. on Vehicular Technology, Vol. 43, No. 3, pp. 808-816, August 1994.

[3] 3GPP2 Tech. Spec. C.S0052-A v1.0, "Source-Controlled Variable-Rate Multimode Wideband Speech Codec (VMR-WB), Service Options 62 and 63 for Spread Spectrum Systems," April 2005; http://www.3gpp2.org

[4] S. P. Lloyd, "Least squares quantization in PCM," IEEE Transactions on Information Theory, Vol. 28, No. 2, pp. 129-136, March 1982.

[5] 3GPP Tech. Spec. 26.290, "Adaptive Multi-Rate-Wideband (AMR-WB+) codec; Transcoding functions," June 2005.

[6] "Extended high-level description of the Q9 EV-VBR baseline codec," ITU-T SG16 Tech. Cont. COM16-C199R1-E, June 2007.

What is claimed is:

1. A transition mode device for use in a predictive-type sound signal codec for producing a transition mode excitation replacing an adaptive codebook excitation in a transition frame and/or at least one frame following the transition in the sound signal, comprising:

an input for receiving a codebook index; and a transition mode codebook for generating a set of codevectors independent from past excitation, the transition mode codebook being responsive to the codebook index for generating, in the transition frame and/or the at least one frame following the transition, one of the codevectors of the set corresponding to said transition mode excitation;

wherein the transition mode codebook comprises a codebook of glottal impulse shapes.

2. A transition mode device as defined in claim 1, wherein the sound signal comprises a speech signal and wherein the transition frame is selected from the group consisting of a frame comprising a voiced onset and a frame comprising a transition between two different voiced sounds.

3. A transition mode device as defined in claim 1, wherein the transition frame and/or the at least one frame following the transition comprise a transition frame followed by several frames.

4. A transition mode device as defined in claim 1, wherein the transition frame and/or the at least one frame following the transition each comprise a plurality of subframes, and wherein the transition mode codebook is used in a first part of the subframes and a predictive-type codebook of the predictive-type codec is used in a second part of the subframes.

5. A transition mode device as defined in claim 1, wherein the codebook of glottal impulse shapes comprises codevectors formed of a glottal impulse shape placed at a specific position in the codevector.

6. A transition mode device as defined in claim 5, wherein the codebook of glottal impulse shapes includes a predetermined number of different shapes of glottal impulses, and wherein each shape of glottal impulse is positioned at a plurality of different positions in the codevectors to form a plurality of different codevectors of the codebook of glottal impulse shapes.

7. A transition mode device as defined in claim 5, wherein the codebook of glottal impulse shape comprises a generator of codevectors containing only one non-zero element and a shaping filter for processing the codevectors containing only one non-zero element to produce codevectors representing glottal impulse shapes centered at different positions.

8. A transition mode device as defined in claim 5, wherein the glottal impulse shapes comprises first and last samples wherein a predetermined number of the first and last samples are truncated.

9. A transition mode device as defined in claim 1, wherein the transition frame and/or the at least one frame following the transition each comprise a plurality of subframes, and wherein the transition mode codebook is used only in the subframe containing a first glottal impulse of a current frame.

10. A transition mode device as defined in claim 9, comprising means for producing, in at least one subframe preceding the subframe using the transition mode codebook, a global excitation signal comprising exclusively an innovation codebook component.

11. An encoder device for generating a transition mode excitation replacing an adaptive codebook excitation in a transition frame and/or at least one frame following the transition in a sound signal, comprising:

a generator of a codebook search target signal;

a transition mode codebook for generating a set of codevectors independent from past excitation, wherein the codevectors of said set each corresponds to a respective transition mode excitation and wherein the transition mode codebook comprises a codebook of glottal impulse shapes;

a searcher of the transition mode codebook for finding the codevector of said set corresponding to the transition mode excitation optimally corresponding to the codebook search target signal.

12. An encoder device as defined in claim 11, wherein the searcher applies a given criterion to every glottal impulse shape of the codebook of glottal impulse shapes and finds as the codevector optimally corresponding to the codebook search target signal the codevector of the set corresponding to a maximum value of said criterion.

13. An encoder device as defined in claim 12, wherein the searcher identifies the found codevector by means of transition mode parameters selected from the group consisting of a transition mode configuration identification, a glottal impulse shape, a position of the glottal impulse shape centre in the found codevector, a transition mode gain, a sign of the transition mode gain and a closed-loop pitch period.

14. An encoder device as defined in claim 11, wherein the sound signal comprises a speech signal and wherein the transition frame is selected from the group consisting of a frame comprising a voiced onset and a frame comprising a transition between two different voiced sounds.

15. An encoder device as defined in claim 11, wherein the transition frame and/or the at least one frame following the transition comprise a transition frame followed by several frames.

16. An encoder device as defined in claim 11, wherein the transition frame and/or the at least one frame following the transition each comprise a plurality of subframes, and wherein the searcher searches the transition mode codebook in a first part of the subframes and a predictive-type codebook of the encoder device in a second part of the subframes.

17. An encoder device as defined in claim 11, wherein the codebook of glottal impulse shapes comprises codevectors formed of a glottal impulse shape placed at a specific position in the codevector.

18. An encoder device as defined in claim 17, wherein the codebook of glottal impulse shapes includes a predetermined number of different shapes of glottal impulses, and wherein each shape of glottal impulse is positioned at a plurality of different positions in the codevectors to form a plurality of different codevectors of the codebook of glottal impulse shapes.

19. An encoder device as defined in claim 17, wherein the codebook of glottal impulse shapes comprises a generator of codevectors containing only one non-zero element and a shaping filter for processing the codevectors containing only one non-zero element to produce codevectors representing glottal impulse shapes centered at different positions.

20. An encoder device as defined in claim 11, further comprising:

a generator of an innovation codebook search target signal;

an innovation codebook for generating a set of innovation codevectors each corresponding to a respective innovation excitation;

a searcher of the innovation codebook for finding the innovation codevector of said set corresponding to an innovation excitation optimally corresponding to the innovation codebook search target signal; and an adder of the transition mode excitation and the innovation excitation to produce a global excitation for a sound signal synthesis filter.

21. An encoder device as defined in claim 20, wherein the transition frame and/or the at least one frame following the transition each comprise a plurality of subframes and wherein, depending on where a glottal impulse or glottal impulses are located in the subframes, the encoder device comprises means for encoding the subframes using at least one of the transition mode codebook, an adaptive codebook and the innovation codebook.

22. An encoder device as defined in claim 11, wherein the transition frame and/or the at least one frame following the transition each comprise a plurality of subframes, and wherein the transition mode codebook is used only in the subframes containing a first glottal impulse of a current frame.

23. An encoder device as defined in claim 22, comprising means for producing, in at least one subframe preceding the subframes using the transition mode codebook, a global excitation signal comprising exclusively an innovation codebook component.

24. A decoder device for generating a transition mode excitation replacing an adaptive codebook excitation in a transition frame and/or at least one frame following the transition in a sound signal, comprising:

an input for receiving a codebook index;

a transition mode codebook for generating a set of codevectors independent from past excitation, the transition mode codebook being responsive to the codebook index for generating in the transition frame and/or at least one frame following the transition one of the codevectors of the set corresponding to the transition mode excitation;

wherein the transition mode codebook is a codebook of glottal impulse shapes.

25. A decoder device as defined in claim 24, wherein the sound signal comprises a speech signal and wherein the transition frame is selected from the group consisting of a frame comprising a voiced onset and a frame comprising a transition between two different voiced sounds.

26. A decoder device as defined in claim 24, wherein the transition frame and/or the at least one frame following the transition each comprise a plurality of subframes, and wherein the transition mode codebook is used in a first part of the subframes and the decoder device comprises a predictive-type codebook that is used in a second part of the subframes.

27. A decoder device as defined in claim 24, wherein the codebook of glottal impulse shapes comprises codevectors formed of a glottal impulse shape placed at a specific position in the codevector.

28. A decoder device as defined in claim 27, wherein the codebook of glottal impulse includes a predetermined number of different shapes of glottal impulses, and wherein each shape of glottal impulse is positioned at a plurality of different positions in the codevectors to form a plurality of different codevectors of the codebook of glottal impulse shapes.

29. A decoder device as defined in claim 27, wherein the codebook of glottal impulse shapes comprises a generator of codevectors containing only one non-zero element and a shaping filter for processing the codevectors containing only one non-zero element to produce codevectors representing glottal impulse shapes centered at different positions.

30. A decoder device as defined in claim 24, further comprising:

an input for receiving an innovation codebook index;

an innovation codebook for generating a set of innovation codevectors, the innovation codebook being responsive to the innovation codebook index for generating in the transition frame and/or at least one frame following the transition one of the innovation codevectors of the set corresponding to an innovation excitation;

an adder of the transition mode excitation and the innovation excitation to produce a global excitation for a sound signal synthesis filter.

31. A transition mode method for use in a predictive-type sound signal codec for producing a transition mode excitation replacing an adaptive codebook excitation in a transition frame and/or at least one frame following the transition in the sound signal, comprising:

receiving, using a codebook index input, a codebook index; and in response to the codebook index from the codebook index input, generating, using a transition mode codebook for generating a set of codevectors independent from past excitation, one of the codevectors of the set corresponding to said transition mode excitation;

wherein the transition mode codebook comprises a codebook of glottal impulse shapes.

32. A transition mode method as defined in claim 31, wherein the sound signal comprises a speech signal and the transition frame comprises a frame comprising a voiced onset or a frame comprising a transition between two different voiced sounds.

33. A transition mode method as defined in claim 31, wherein the transition frame and/or the at least one frame following the transition comprise a transition frame followed by several frames.

34. A transition mode method as defined in claim 31, wherein the transition frame and/or the at least one frame following the transition each comprise a plurality of subframes, and said method comprises using the transition mode codebook in a first part of the subframes and a predictive-type codebook of the predictive-type codec in a second part of the subframes.

35. A transition mode method as defined in claim 31, wherein the codebook of glottal impulse shapes comprises codevectors formed of a glottal impulse shape placed at a specific position in the codevector.

36. A transition mode method as defined in claim 35, wherein the codebook of glottal impulse shapes includes a predetermined number of different shapes of glottal impulses, and wherein the codebook of glottal impulse shapes comprises a plurality of different codevectors formed by positioning each shape of glottal impulse at a plurality of different positions in the codevector.

37. A transition mode method as defined in claim 35, comprising generating, using the codebook of glottal impulse shapes, codevectors containing only one non-zero element and processing, using a shaping filter, the codevectors containing only one non-zero element to produce codevectors representing glottal impulse shapes centered at different positions.

38. A transition mode method as defined in claim 35, wherein the glottal-shape impulses comprises first and last samples, wherein a predetermined number of the first and last samples are truncated.

39. A transition mode method as defined in claim 31, wherein the transition frame and/or the at least one frame following the transition each comprise a plurality of subframes, and wherein the transition mode codebook is used in the subframe containing a first glottal impulse of a current frame.

40. A transition mode method as defined in claim 39, comprising producing, using producing means in at least one subframe preceding the subframe using the transition mode codebook, a global excitation signal comprising exclusively an innovation codebook component.

41. An encoding method for generating a transition mode excitation replacing an adaptive codebook excitation in a transition frame and/or at least one frame following the transition in a sound signal, comprising:

generating, using a codebook search target signal generator, a codebook search target signal;

in response to the codebook search target signal searching, using a transition mode codebook searcher, a transition mode codebook for generating a set of codevectors independent from past excitation and each corresponding to a respective transition mode excitation, for finding the codevector of said set corresponding to a transition mode excitation optimally corresponding to the codebook search target signal;

wherein the transition mode codebook comprises a codebook of glottal impulse shapes.

42. An encoding method as defined in claim 41, wherein searching, using the transition mode codebook searcher, the transition mode codebook comprises applying a given criterion to every glottal impulse shape of the codebook of glottal impulse shapes and finding as the codevector optimally corresponding to the codebook search target signal the codevector of the set corresponding to a maximum value of said criterion.

43. An encoding method as defined in claim 42, wherein searching, using the transition mode codebook searcher, the transition mode codebook comprises identifying the found codevector by means of transition mode parameters selected from the group consisting of a transition mode configuration identification, a glottal impulse shape, a position of the glottal impulse shape centre in the found codevector, a transition mode gain, a sign of the transition mode gain and a closed-loop pitch period.

44. An encoding method as defined in claim 41, wherein the sound signal comprises a speech signal and the transition frame comprises a frame comprising a voiced onset or a frame comprising a transition between two different voiced sounds.

45. An encoding method as defined in claim 41, wherein the transition frame and/or the at least one frame following the transition each comprise a plurality of subframes, and wherein searching, using a transition mode codebook searcher, the transition mode codebook comprises searching the transition mode codebook in a first part of the subframes and searching a predictive-type codebook of the encoder device in a second part of the subframes.

46. An encoding method as defined in claim 41, wherein the codebook of glottal impulse shapes comprises codevectors formed of a glottal impulse shape placed at a specific position in the codevector.

47. An encoding method as defined in claim 46, wherein the codebook of glottal impulse shapes includes a predetermined number of different shapes of glottal impulses, and the codebook of glottal impulse shapes comprises a plurality of different codevectors formed by positioning each shape of glottal impulse at a plurality of different positions in the codevectors.

48. An encoding method as defined in claim 46, wherein generating in the glottal-impulse-shape codebook the set of codevectors independent from past excitation comprises generating, using the glottal-impulse-shape codebook, codevectors containing only one non-zero element and processing, using a shaping filter, the codevectors containing only one non-zero element to produce codevectors representing glottal impulse shapes centered at different positions.

49. An encoding method as defined in claim 41, further comprising:

generating, using an innovation codebook search target signal generator, an innovation codebook search target signal;

in response to the innovation codebook search target signal searching, using an innovation codebook searcher, an innovation codebook for generating a set of innovation codevectors each corresponding to a respective innovation excitation, for finding the innovation codevector of said set corresponding to an innovation excitation optimally corresponding to the innovation codebook search target signal; and adding, using an adder, the transition mode excitation and the innovation excitation to produce a global excitation for a sound signal synthesis filter.

50. An encoding method as defined in claim 49, wherein the transition frame and/or the at least one frame following the transition each comprise a plurality of subframes and wherein, depending on where a glottal impulse or glottal impulses are located in the subframes, the encoding method comprises encoding the subframes using at least one of the transition mode codebook, the adaptive codebook and the innovation codebook.

51. A transition mode method as defined in claim 41, wherein the transition frame and/or the at least one frame following the transition each comprise a plurality of subframes, and wherein said method comprises using the transition mode codebook in the subframe containing a first glottal impulse of a current frame.

52. A transition mode method as defined in claim 51, comprising producing, using producing means in at least one subframe preceding the subframe using the transition mode codebook, a global excitation signal comprising exclusively an innovation codebook component.

53. A decoding method for generating a transition mode excitation replacing an adaptive codebook excitation in a transition frame and/or at least one frame following the transition in a sound signal, comprising:

receiving, using a codebook index input, a codebook index; and in response to the codebook index generating, using a transition mode codebook for generating a set of codevectors independent from past excitation, one of the codevectors of the set corresponding to the transition mode excitation;

wherein the transition mode codebook comprises a codebook of glottal impulse shapes.

54. A decoding method as defined in claim 53, wherein the sound signal comprises a speech signal and wherein the transition frame comprises a frame comprising a voiced onset or a frame comprising a transition between two different voiced sounds.

55. A decoding method as defined in claim 53, wherein the transition frame and/or the at least one frame following the transition each comprise a plurality of subframes, and wherein said method comprises using the transition mode codebook in a first part of the subframes and a predictive-type codebook in a second part of the subframes.

56. A decoding method as defined in claim 53, wherein the codebook of glottal impulse shapes comprises codevectors formed of a glottal impulse shape placed at a specific position in the codevector.

57. A decoding method as defined in claim 56, wherein the codebook of glottal impulse shapes includes a predetermined number of different shapes of glottal impulses, and wherein the codebook of glottal impulse shaped comprises a plurality of different codevectors formed by positioning each shape of glottal impulse at a plurality of different positions in the codevector.

58. A decoding method as defined in claim 56, wherein codevectors of the set are generated, using the glottal-impulse-shape codebook, by generating codevectors containing only one non-zero element and processing, using a shaping filter, the codevectors containing only one non-zero element to produce codevectors representing glottal impulse shapes centered at different positions.

59. A decoding method as defined in claim 53, further comprising:

receiving, using an innovation codebook index input, an innovation codebook index;

in response to the innovation codebook index generating, using an innovation codebook for generating a set of innovation codevectors, one of the innovation codevectors of the set corresponding to an innovation excitation; and adding, using an adder, the transition mode excitation and the innovation excitation to produce a global excitation for a sound signal synthesis filter.

* * * * *